US008870486B2

(12) United States Patent
Castro et al.

(10) Patent No.: US 8,870,486 B2
(45) Date of Patent: Oct. 28, 2014

(54) EXCHANGEABLE ATTACHMENTS AND APPARATUS AND METHODS FOR RETAINING EXCHANGEABLE ATTACHMENTS

(76) Inventors: Robert David Castro, Hewitt, NJ (US); Russell Edward Castro, Marlboro, NJ (US)

( * ) Notice: Subject to any disclaimer, the term of this patent is extended or adjusted under 35 U.S.C. 154(b) by 798 days.

(21) Appl. No.: 12/533,626

(22) Filed: Jul. 31, 2009

(65) Prior Publication Data

US 2011/0027002 A1 Feb. 3, 2011

(51) Int. Cl.

| | |
|---|---|
| ***B43K 29/00*** | (2006.01) |
| ***B43K 29/20*** | (2006.01) |
| ***B43K 31/00*** | (2006.01) |
| ***B43K 23/12*** | (2006.01) |

(52) U.S. Cl.

CPC ..... *B43K 23/12* (2013.01); *B43K 29/00* (2013.01); *B43K 29/20* (2013.01); *B43K 31/00* (2013.01)

USPC ..... 401/195; 401/52

(58) Field of Classification Search

USPC ..... 401/195, 52; 63/40; D19/36, 46, 54, 58; 40/334, 905

See application file for complete search history.

(56) References Cited

U.S. PATENT DOCUMENTS

| | | | | |
|---|---|---|---|---|
| 1,655,365 | A * | 1/1928 | Morris | 40/334 |
| 2,029,877 | A * | 2/1936 | Knudsen | 40/334 |
| 4,336,882 | A * | 6/1982 | Sakwa | 401/195 |
| 4,879,882 | A | 11/1989 | Johnson et al. | |
| 4,928,416 | A | 5/1990 | Penno | |
| 5,086,577 | A | 2/1992 | Abernethy | |
| 5,186,562 | A | 2/1993 | Yoshinaga et al. | |
| 5,433,642 | A | 7/1995 | Chia | |
| 6,056,464 | A | 5/2000 | Cohen | |
| 6,244,772 | B1 * | 6/2001 | Ruchonnet | 401/195 |
| 6,971,812 | B1 | 12/2005 | Chen | |
| 7,059,797 | B2 | 6/2006 | Sellars | |
| 7,086,798 | B1 | 8/2006 | Cetera | |
| 7,698,836 | B2 * | 4/2010 | Schmelzer et al. | 63/40 |
| 2003/0141327 | A1 | 7/2003 | Cruise et al. | |
| 2007/0044512 | A1 | 3/2007 | Smith | |

FOREIGN PATENT DOCUMENTS

| | | | |
|---|---|---|---|
| WO | WO 2007/022632 | A1 | 3/2007 |

* cited by examiner

*Primary Examiner* — David Walczak
*Assistant Examiner* — Bradley Oliver
(74) *Attorney, Agent, or Firm* — Rita C. Chipperson, Esq.; Chipperson Law Group, P.C.

(57) ABSTRACT

Exchangeable attachments and apparatus and methods for retaining exchangeable and tradable attachments, such as attachments that are removably attached to a retainer. Retainers may be located on, for example, the non-marking end of a writing implement, hair barrettes, shoe laces, bracelets, broaches, earrings, keychains, necklaces, rings, etc. Attachments may be coupled to a receptacle located in the retainer, wherein the attachment is inserted into a receptacle and rotated in a first direction to couple the attachment to the retainer, and wherein the attachment is rotated in a second direction and removed from the receptacle to uncouple the attachment from the retainer. Attachments may be stored internal to the apparatus to which the retainer is attached. Attachments may include identifying indicia or other designs. The retainer may include protrusions or another type of stand to allow the attachments to be displayed while the retainer is removed from the writing implement.

11 Claims, 30 Drawing Sheets

EXCHANGEABLE ATTACHMENTS AND APPARATUS AND METHODS FOR RETAINING EXCHANGEABLE ATTACHMENTS

BACKGROUND OF THE INVENTION

Embodiments of the present invention generally relate to attachments and apparatus and methods for retaining exchangeable attachments.

Generally, there is a need for products that foster relationships through the process of trading or collecting. For example, many children collect and trade baseball cards, stamps, etc. In addition, many children and people of all age groups frequently purchase items with indicia such as their name or preferences but retain them for individual use rather than trading or collecting with other individuals. However, there remains a need for a product that allows trading and displaying of such indicia with friends and relations in a convenient manner. Such a satisfying apparatus would allow children to collect and display items from friends and acquaintances who are important or significant. In addition, the child would be able to give items with their indicia to others and therefore promote friendship or relationships with other individuals.

Some apparatus and methods are known for exchanging or interchanging attachments according to user preference. For example, one such device known in the art is a multiple interchangeable pin carrier attachment system. Such a system includes a pin and at least one attachment releasably coupled to the pin. Attachments are constructed to be exchanged with different attachments from other carriers, which also releasably attach to the carrier or attachment. Decorative indicia such as a name or other identifying indicia are placed on each attachment. Owners of different pin carriers can exchange attachments having their identifying indicia with one another for purposes of trade or friendship.

Another such device that allows user to exchange attachments is a system for interchangeable jewelry attachments or inserts. Jewelry inserts have a displayed end and an attachment end, the latter of which couples with the receptacle receiving the insert. The jewelry attachments couple to the receptacle via the use of an elastically deformable extension that allows a user to remove and replace different jewelry attachments without any tools.

Similarly, another known apparatus for removably coupled jewelry attachments includes a pendent and indicia displayed as a necklace, bracelet, pin, or earring. The pendent has a vertical stem with a retainer at the bottom and a stem that retains several beads containing indicia thereon. A retainer is then coupled to the top of the pendent that simultaneously prevents the beads from being removed and allows a user to attach the pendent to a chain or other display means. Users can exchange beads with other users to promote friendship and/or create an aesthetically pleasing pendent.

Another system known in the art includes a band with interchangeable members that can be configured to be worn as a bracelet, anklet, or necklace. This band has a releasable closure with several loops that encircle the band and can be slidably removed from the band when it is open. Each of the loops includes some form of indicia such as initials, logos, patterns, etc. Children can open the band and then exchange loops with others having different or unique indicia on the loops of their band.

BRIEF SUMMARY OF THE INVENTION

Briefly stated, in one aspect of the present invention, a writing apparatus is provided. This apparatus includes: a body; a retainer coupled to said body, said retainer including at least one receptacle; at least one marking mechanism coupled to said body; and at least one attachment, said attachment configured to removably mate with said at least one receptacle.

In another aspect of the present invention, a writing apparatus is provided. This apparatus includes: a body, said body including a first body section and a second body section, said first body section and said second body section separated via a disk; a retainer removably coupled to said body, said retainer including a plurality of receptacles arranged circularly, a centrally located cylindrical recess, and a plurality of arced recesses; at least one marking mechanism; and at least one attachment, said attachment configured to removably mate with said at least one receptacle.

In yet another aspect of the present invention, a method of coupling an attachment to a retainer receptacle is provided. This method includes the following steps: aligning a first protrusion of said attachment with a first axial channel of said retainer receptacle; aligning a second protrusion of said attachment with a second axial channel of said retainer receptacle; sliding said first protrusion through said first axial channel while simultaneously sliding said second protrusion through said second axial channel until said first protrusion exits said first channel and said second protrusion exits said second channel; and rotating a head of said attachment in a clockwise or counterclockwise direction.

In a further aspect of the present invention, an apparatus for retaining exchangeable attachments is provided. This apparatus includes: a body; at least one receptacle within said body; and at least one attachment, said attachment including a head and a base coupled to said head, said base configured to removably mate with said at least one receptacle, said base configured to lock said attachment in a mated position in which said attachment is mated to said receptacle.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
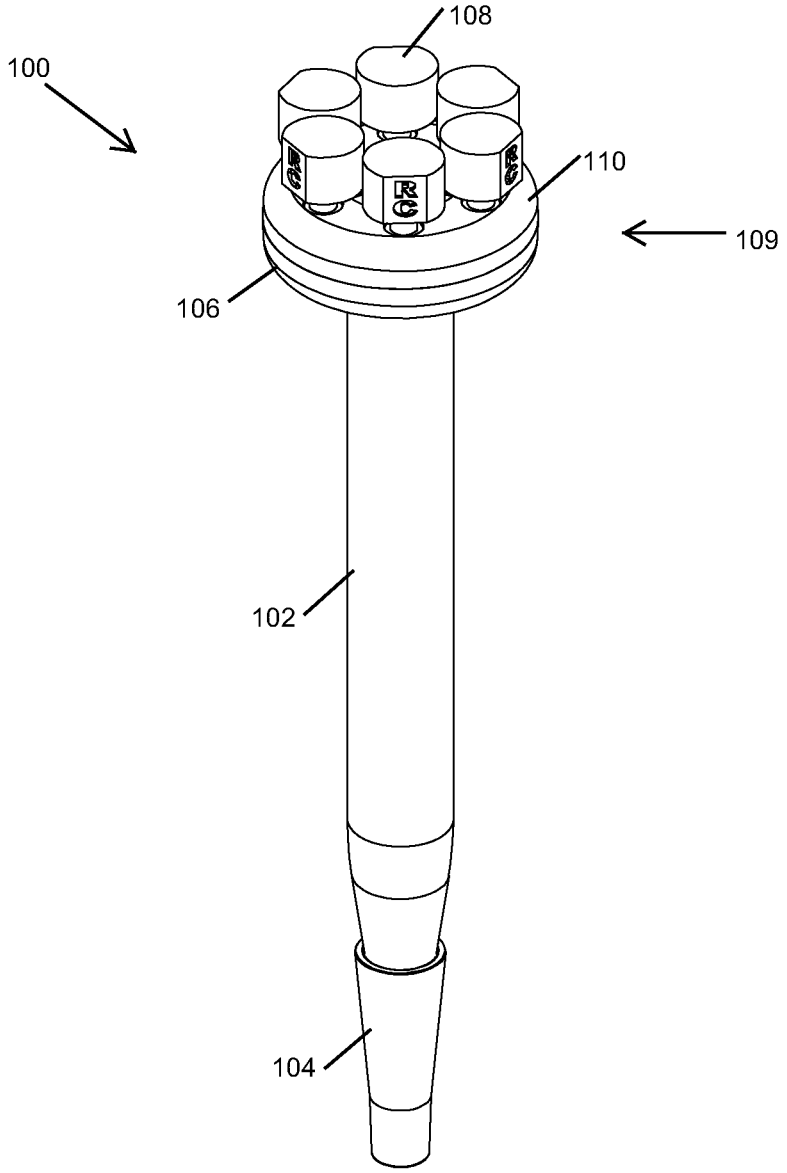
FIG. 1 is a perspective view of a writing implement apparatus for retaining exchangeable attachments in accordance with one embodiment of the present invention.

Certain terminology may be used in the following description for convenience only and is not limiting. The words "lower" and "upper" and "top" and "bottom" designate directions in the drawings to which reference is made. The terminology includes the words above specifically mentioned, derivatives thereof and words of similar import.

Where a term is provided in the singular, the inventors also contemplate aspects of the invention described by the plural of that term. As used in this specification and in the appended claims, the singular forms "a", "an" and "the" include plural references unless the context clearly dictates otherwise, e.g., "an attachment" may include a plurality of attachments. Thus, for example, a reference to "a method" includes one or more methods, and/or steps of the type described herein and/or which will become apparent to those persons skilled in the art upon reading this disclosure.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods, constructs and materials are now described. All publications mentioned herein are incorporated herein by reference in their entirety. Where there are discrepancies in terms and definitions used in references that are incorporated by reference, the terms used in this application shall have the definitions given herein.

Referring first to FIG. 1, depicted is a perspective view of apparatus 100 in accordance with one embodiment of the present invention. Apparatus 100 includes, inter alia, body 102, cap 104, retainer 109, and a plurality of attachments 108. Retainer 109 includes retainer lower portion 106 and retainer upper portion 110. Apparatus 100 includes retainer 109, which is designed to removably retain attachments to facilitate exchange of attachments, for example, among children. In the depicted embodiment of the present invention, apparatus 100 is designed for dual use as a writing implement (i.e., a pen). Although retainer 109 is coupled to a writing implement in FIG. 1, retainer 109 may be coupled to non-writing implement apparatus without departing from the scope of the present invention. Also, varying forms of retainers may be substituted as discussed in greater detail below. Further, although the writing implement apparatus depicted in FIG. 1 is in the form of a pen, alternate embodiments of writing implement apparatus may be substituted without departing from the scope of the present invention including, but not limited to, pencils, markers, and paintbrushes.

Figure 2:
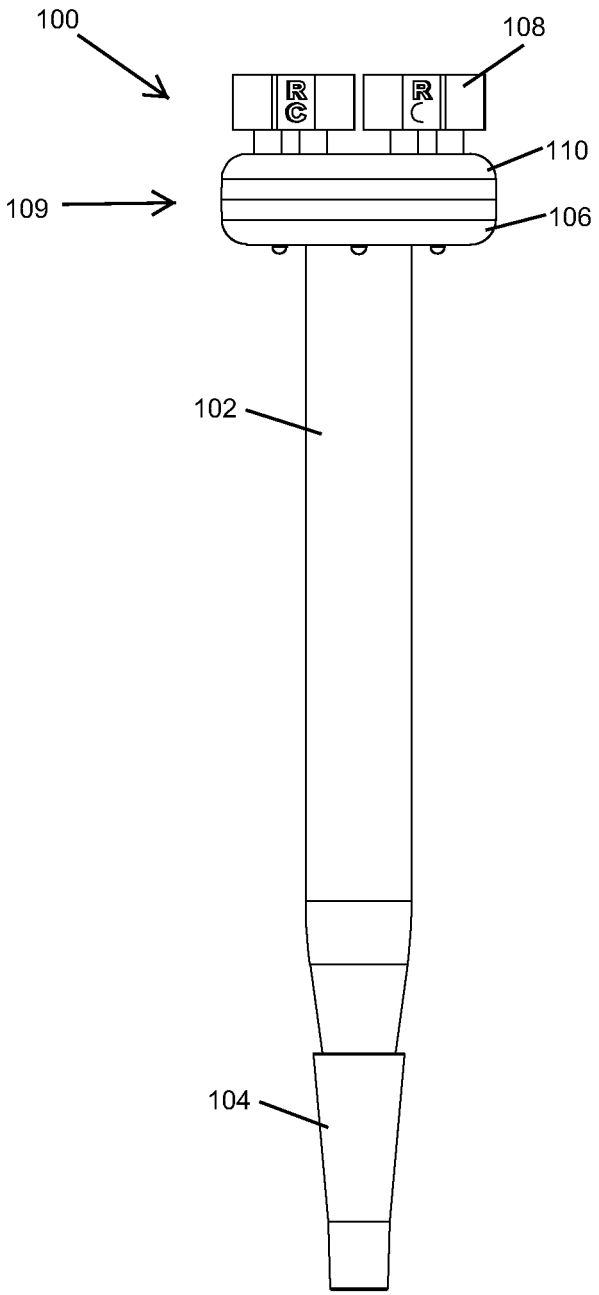
FIG. 2 is an elevational side view of the apparatus of FIG. 1.
Figure 3:
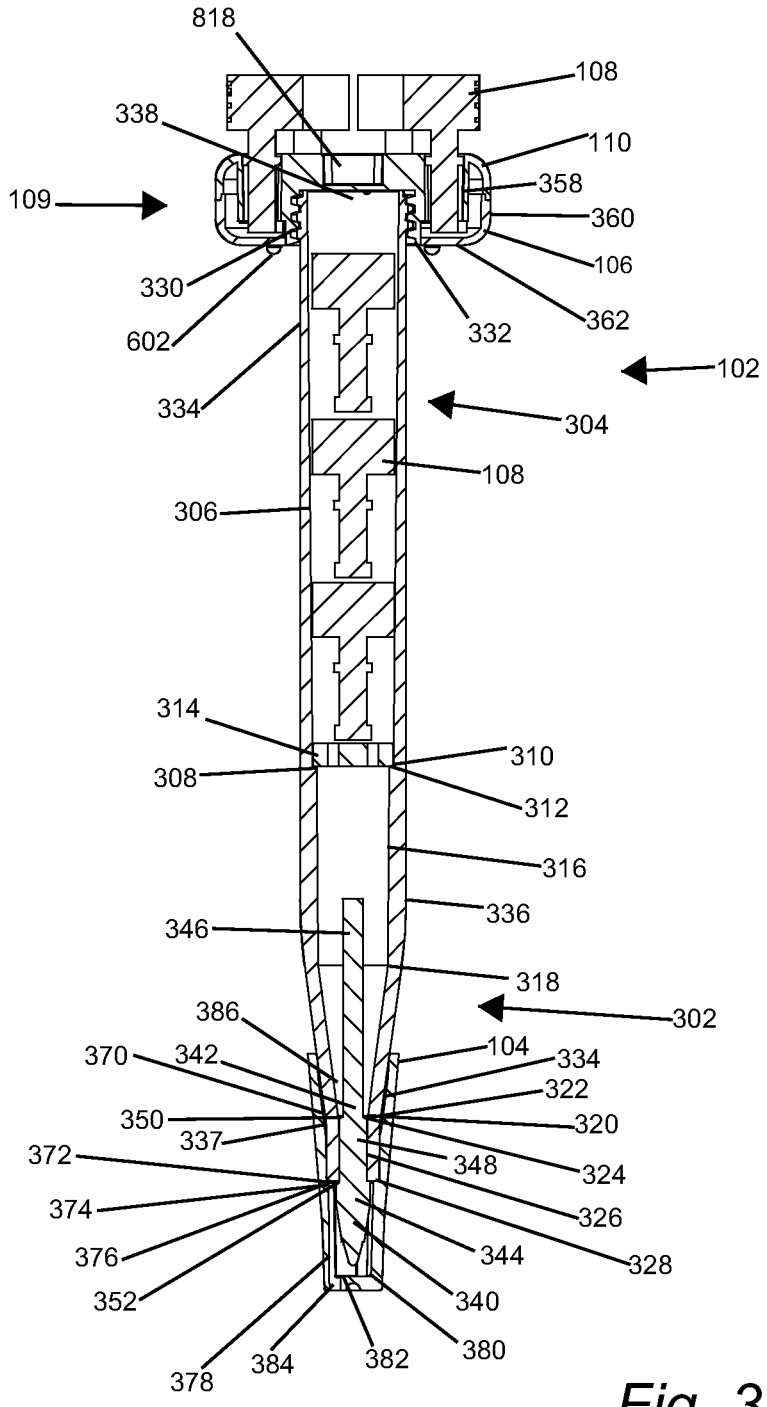
FIG. 3 is a cross-sectional view of the apparatus depicted in FIG. 1 taken along lines 3-3 of FIG. 4B.
Figure 4A:
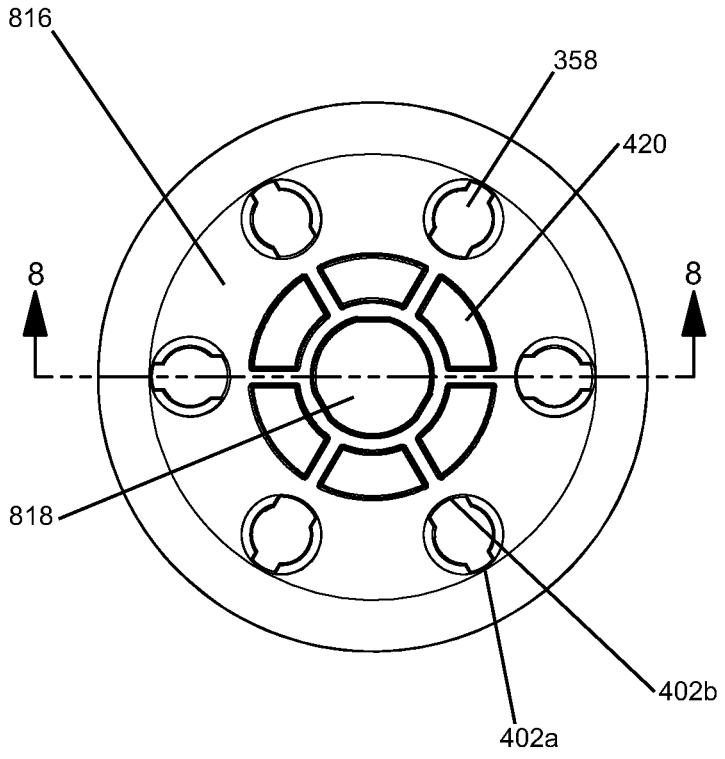
FIG. 4A is a top view of the retainer of the apparatus of FIG. 1, such retainer without attachments and removed from the body of the apparatus.
Figure 4B:
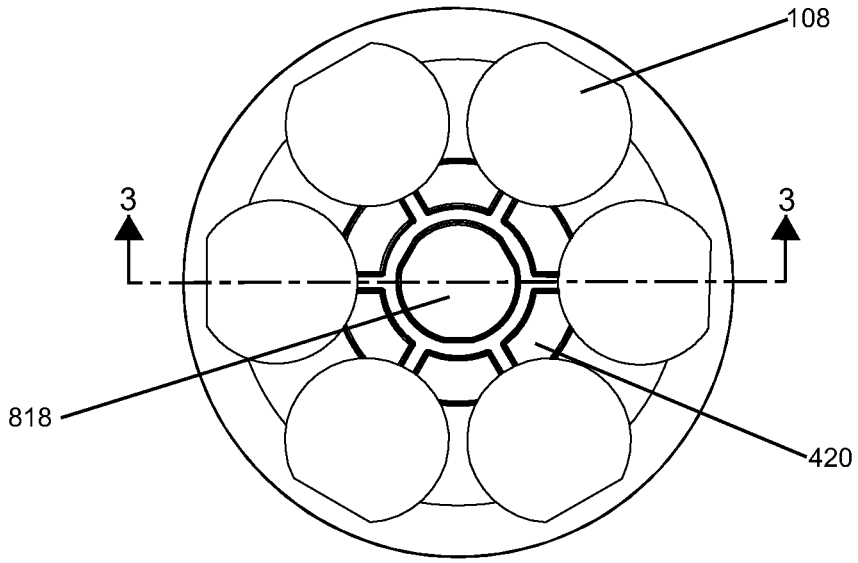
FIG. 4B is a top view of the apparatus of FIG. 1 with attachments.

Turning now to FIGS. 2 and 3, depicted are side and cross-sectional views of apparatus 100, respectively, wherein the cross-sectional view is taken along lines 3-3 of FIG. 4B. In the depicted embodiment, body 102 is a substantially tubular body molded to the free state shape illustrated in FIGS. 2 and 3. The hollow interior of body 102 includes two sections, namely, first and second body sections 302 and 304, respectively. During use of apparatus 100 as a writing implement, first body section 302 is located below second body section 304. First body section 302 is designed to removably attach marking mechanism 340 and cap 104 to body 102, and second body section 304 is designed to house attachments 108 and to removably attach retainer 109.

Figure 9A:
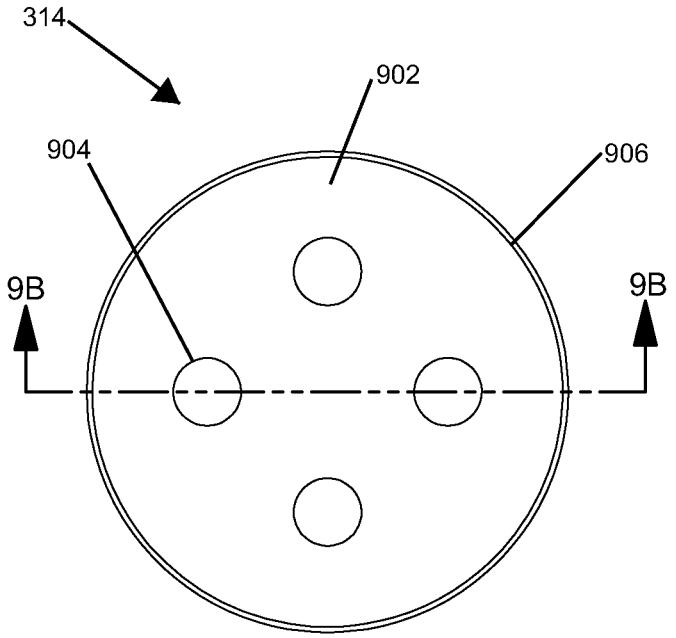
FIG. 9A is a top view of the disk of the apparatus of FIG. 1.
Figure 9B:
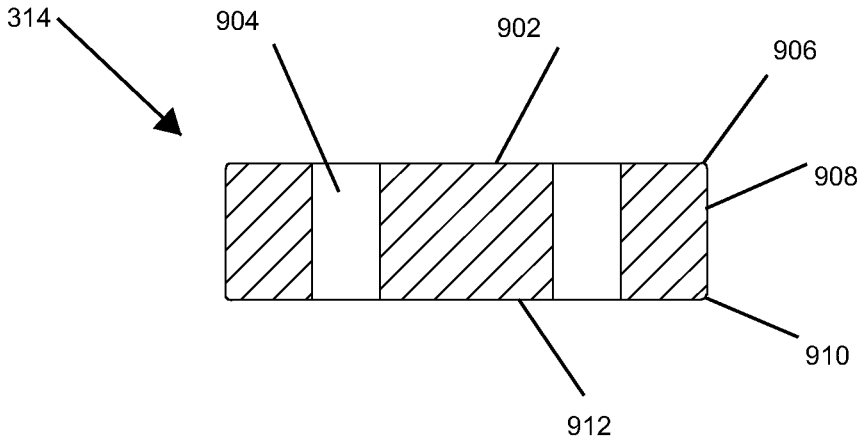
FIG. 9B is a side elevational view of the disk of the apparatus of FIG. 1.

First body section 302 and second body section 304 are separated via disk 314. Disk 314 is a substantially cylindrical body molded to the free state shape illustrated in FIGS. 9A and 9B. Disk 314 has upper surface 902, which is substantially planar with the exception of a plurality of vent holes 904, which are substantially tubular in shape and are provided to allow air to flow freely between first body section 302 and second body section 304. At corner 906, disk 314 transitions to exterior wall 908. This wall continues axially downward with a substantially fixed diameter until lower corner 910. Substantially planar lower surface 912 constitutes the bottom of disk 314 with the exception of vent holes 904. Although four vent holes are depicted in the preferred embodiment, varying quantities of vent holes may be substituted without departing from the scope of the present invention. Further, although disk 314 is depicted in FIG. 9 as substantially cylindrical, alternate forms of disk 314 may be substituted without departing from the scope of the present invention.

Referring back to FIG. 3, second body section 304 has an open distal end with a substantially cylindrical inner wall 306. This wall continues axially downward with a substantially fixed radial diameter until it reaches corner 310, at which inner wall 306 transitions radially inward in a substantially horizontal manner to form internal ledge 312. When inserted into second body section 304, disk 314 rests atop ledge 312. At inner corner 308, ledge 312 intersects with inner wall 316 of first body section 302.

Inner wall 316 of first body section 302 extends axially downward from inner corner 308 with a substantially fixed radial diameter until point 318 at which it converges radially inward and axially downward in a frusto-conical manner until corner 320. At corner 320, inner wall 316 transitions radially inward in a substantially horizontal manner to corner 324. From corner 324, marking mechanism wall 326 extends radially downward with a substantially fixed radial diameter. External bottommost surface 328 converges radially outward from the bottommost end of marking mechanism wall 326 in a substantially horizontal manner surrounding the bottommost aperture of body 102.

Still referring to FIG. 3, the topmost end of the exterior of body 102 is substantially horizontal with aperture 338 passing therethrough. The outwardly facing external surface of the uppermost end of body 102 includes threads 330. Threads 330 are in the form of a projecting helical rib that protrudes around the external perimeter of body 102 and is designed to mate with helical groove 332 of retainer lower portion 106. Threads 330 facilitate the removable attachment of retainer 109 to body 102, which allows a user to access the interior of second body section 304 for purposes such as storing attachments 108 as discussed in greater detail below. Although in the depicted embodiment retainer 109 threads to body 102, alternate forms of attaching a retainer to a body may be substituted without departing from the scope of the present invention. Also, embodiments of the present invention without storage capabilities are envisioned in which the retainer is not removable from the body. For example, storage may be removed or lessened in order to accommodate a larger ink cartridge for the marking mechanism.

Below threads 330, external wall 334 extends axially downward with a substantially fixed radius until point 336, at which external wall 334 extends radially inward in a frusto-conical manner until transition 337. Below transition 337, external wall 334 extends radially downward with a substantially fixed radius until the bottommost end of external wall 334 intersects with the outermost edge of surface 328.

Body 102 receives and removably retains a marking mechanism, such as marking mechanism 340, in first body section 302 as depicted in FIG. 3. In the depicted embodiment of the present invention, body 102 is designed to accept and mate with a standard, existing, commercially available marking mechanism in the form of a nib. In the depicted embodiment, this marking mechanism includes marking mechanism body 342 and marking mechanism point 344. Marking mechanism body 342 includes a cylindrical proximal end section 346 having a first substantially fixed diameter and a second distal end section 348 having a second substantially fixed diameter that is slightly larger than the first substantially fixed diameter. The intersection of the proximal end and distal end occurs in the form of proximal marking mechanism ledge 350. Proximal marking mechanism ledge 350 extends radially outward in a substantially horizontal manner from the exterior of proximal end section 346 to the exterior of second distal end section 348. The proximal end of marking mechanism point 344 intersects with the distal end of distal end section 348 in the form of distal marking mechanism ledge 352. Distal marking mechanism ledge 352 extends radially outward in a substantially horizontal manner from the exterior of distal end section 348 to the exterior of the proximal end of marking mechanism point 344. The distal end of marking mechanism point 344 tapers in a conical manner.

To couple marking mechanism 340 to body 102, the proximal end of end section 346 is passed through the substantially centrally located aperture passing through surface 328 until the point at which proximal marking mechanism ledge 350 abuts ledge 322 and distal marking mechanism ledge 352 abuts surface 328. Marking mechanism 340 is held in place due to the compressive forces exerted by the interior walls of first body section 302 upon the external surfaces of marking mechanism 340. Such compressive forces are typically caused due to the slightly larger sizing of marking mechanism 340 relative to the sizing of the associated interior surfaces of body 102. Although the attachment of marking mechanism 340 to body 102 is specified in detail, alternate configurations of marking mechanism 340 and body 102 and/or first body section 302 may be substituted without departing from the scope of the present invention.

Cap 104 is a substantially frusto-conical body molded to the free state shape illustrated in FIGS. 2 and 3. Cap 104 has an aperture 386 in its proximal end with a substantially frusto-conical inner wall 370 that converges radially inward and axially downward in a frusto-conical shape until corner 372, at which inner wall 370 transitions radially inward in a substantially horizontal manner to form internal ledge 374. Inner corner 376 is located at the innermost point of internal ledge 374. From corner 376, lower inner wall 378 extends radially downward with a substantially fixed radial diameter until corner 380, at which inner wall 378 intersects with floor 382. Floor 382 is substantially horizontal with the exception of cap vents 384. Cap vents 384 allow air to move freely between the surrounding environment and the inside of cap 104, thereby facilitating application and removal of cap 104 from body 102.

To couple cap 104 to body 102, marking mechanism point 344 is passed through the substantially centrally located aperture 386 until the point at which internal ledge 374 abuts external bottommost surface 328. Cap 104 is held in place due to the compressive forces exerted by the interior surfaces of cap 104 upon the external surfaces of first body section 302. Such compressive forces are caused by the slightly larger sizing of first body section 302 relative to the sizing of the associated interior surfaces of cap 104. Although the attachment of cap 104 to body 102 is specified in detail, alternate configurations of cap 104 and body 102 may be substituted without departing from the scope of the present invention.

Figure 7:
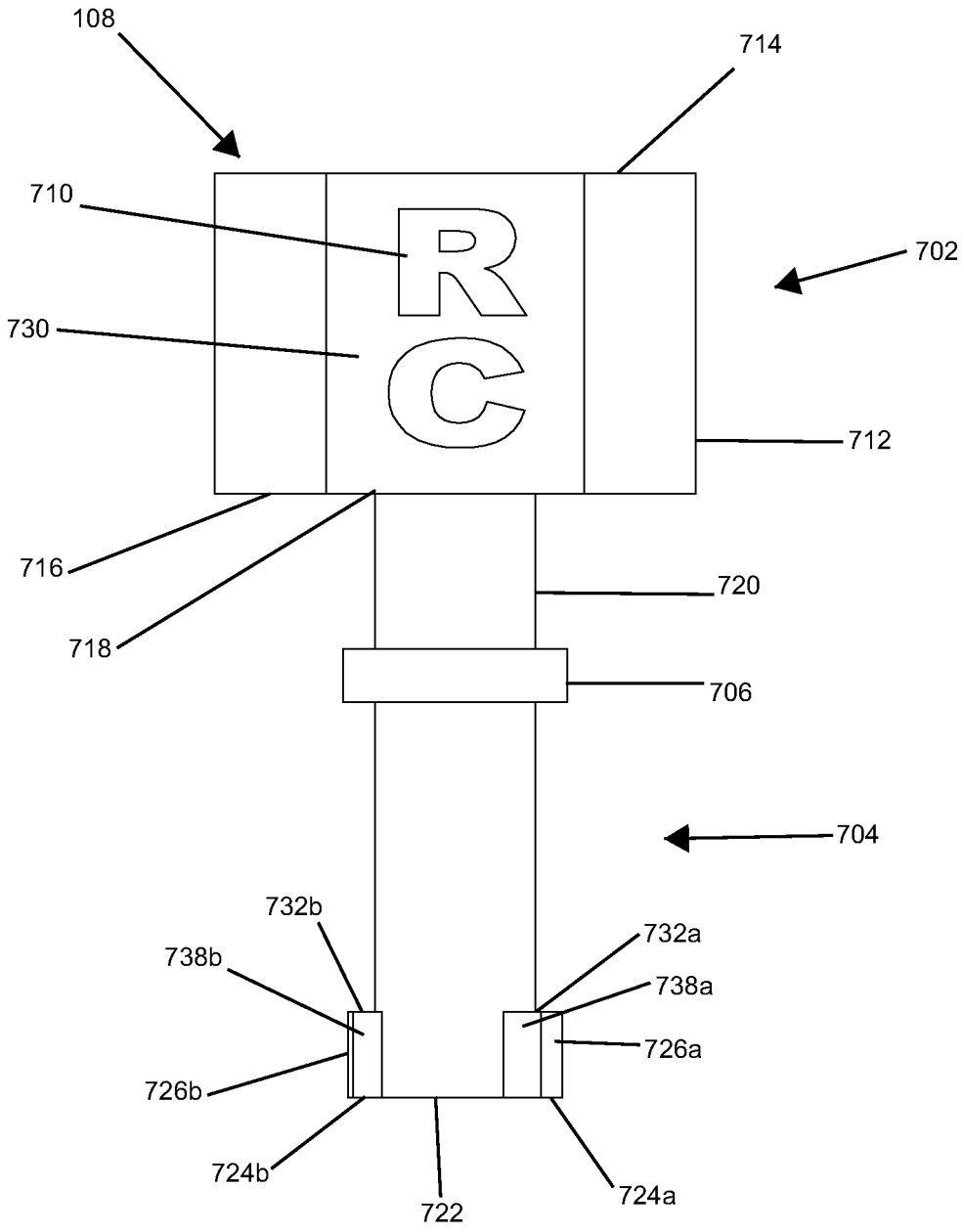
FIG. 7 is a side view of a first attachment for use with the apparatus of FIG. 1 in accordance with one embodiment of the present invention.

Attachments 108 are coupled to body 102 via retainer 109 at the end opposite cap 104. In the depicted embodiment of the present invention and as best seen in FIG. 7, attachments 108 include a substantially cylindrical head 702 coupled to a substantially cylindrical base 704, the latter of which includes bead 706, protrusion 724*a*, and protrusion 724*b*, all of which are molded to the free state shape illustrated in FIG. 7. The upwardly facing surface 714 of head 702 is substantially horizontal. The perimeter of surface 714 intersects with external wall 712, which extends radially downward with a substantially fixed diameter, such diameter approximately equal to the diameter of upwardly facing surface 714, with the exception of outer face 730. Outer face 730 forms a chord passing through upwardly facing surface 714 which extends axially downward in a substantially planar manner. The substantially planar nature of outer face 730 provides a surface upon which a design such as design 710 or the like may be printed for viewing by a user when the corresponding attachment 108 is coupled to retainer 109. At the bottommost end of wall 712, wall 712 intersects with the perimeter of downwardly facing surface 716. Downwardly facing surface 716 is substantially horizontal until it intersects with the topmost end of base 704.

The upwardly facing surface 718 of base 704 is substantially horizontal. The perimeter of surface 718 intersects with external wall 720, which extends radially downward with a substantially fixed diameter, such diameter approximately equal to the diameter of upwardly facing surface 718. At the bottommost end of wall 720, wall 720 intersects with downwardly facing surface 722. Downwardly facing surface 722 is substantially horizontal.

Bead 706 protrudes from wall 720 in a substantially cylindrical manner surrounding the circumference thereof. Bead 706 limits the depth into retainer 109 that attachment 108 may be inserted to ensure proper positioning of attachment 108 relative to retainer 109. Additionally, two arc-shaped attachment protrusions 724*a* and 724*b* of approximately equal height are located at the distal end of base 704 on radially opposing sides thereof. Attachment protrusions 724*a* and 724*b* also include radial outwardly facing surfaces 726*a* and 726*b*, respectively, upwardly facing surfaces 732*a* and 732*b*, respectively, and two identical latitudinal surfaces 738*a* and 738*b*, respectively, located on either side of radial outwardly facing surfaces 726. Attachment protrusions 724 facilitate retention of attachment 108 within retainer 109 as discussed in further detail below.

Outer face 730 includes design 710. In the depicted embodiment, design 710 is in the form of initials, namely, "RC", which act to identify the original owner of the attachment. Design 710 allows attachments to be corresponded to the original owner after they have been exchanged or otherwise given to another apparatus user. For example, a first user may begin with a plurality of attachments that include the first user's initials. When the first user trades one of his or her attachments with a second user, the second user will identify the first user's attachment by matching the design, or initials, located on the attachment to the other apparatus users with whom the second user has exchanged attachments. Design 710 also allows a recipient of an exchanged attachment to display to others that he or she is friends, or otherwise associated with, the owner of the received attachment. Such display occurs via coupling of the attachment to a body via a retainer as discussed herein in a manner that displays design 710. That is, the location of design 710 relative to attachment 108 is selected to ensure that design 710 is visible to others after attachment 108 is coupled to body 102 (i.e., after it has been rotated to its locked position as discussed in greater detail below). This is illustrated in FIGS. 1 and 2, wherein the initials, RC, are located on outer face 730, which passes through the outwardly facing portion of wall 712 to ensure visibility to a viewer of apparatus 100. Although design 710 is depicted in a manner in which it identifies its owner, other non-identifying designs may be substituted including, but not limited to, sports designs (e.g., basketball player, basketball, golf ball, baseball, etc.), trains, and vehicles. Although head 702 is depicted in FIG. 7 as substantially cylindrical, alternate embodiments of head 702 may be substituted without departing from the scope of the present invention. For example, head 702 may be in the form of an object (e.g., basketball, golf ball, star, etc.) or a figure (e.g., a basketball player, a golf player, a ballerina, etc.).

Referring back to FIG. 3, in the depicted embodiment of the present invention, retainer 109 is a two-piece cylindrical body molded to the free state shape illustrated in FIGS. 3, 4A-4B, 5A-5B, 6A-6C, and 8. That is, retainer 109 includes retainer lower portion 106 and retainer upper portion 110.

Retainer lower portion 106 has outwardly facing surface 360 having a substantially fixed radial distance relative to the axis of retainer 109. The bottommost edge of outwardly facing surface 360 curves radially inward and axially downward until it intersects with downwardly facing surface 362.

Figure 6A:
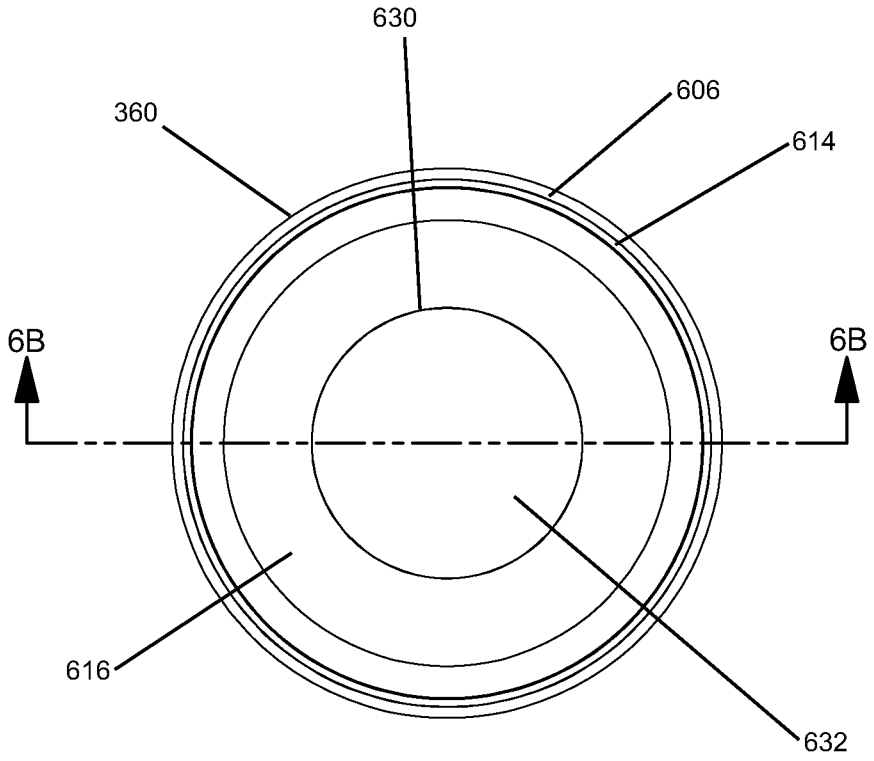
FIG. 6A is a top view of the lower portion of the retainer of the apparatus of FIG. 1, such lower portion of the retainer without attachments and removed from the body of the apparatus.
Figure 6B:
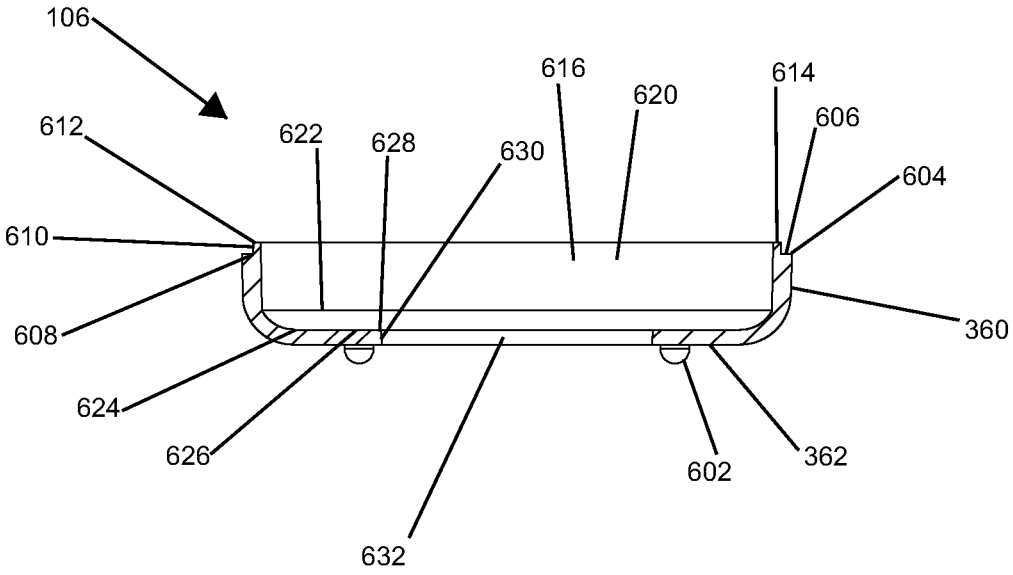
FIG. 6B is a cross-sectional view of the lower portion of the retainer of the apparatus of FIG. 1 taken along lines 6B-6B of FIG. 6A, such lower portion of the retainer without attachments and removed from the body of the apparatus.
Figure 6C:
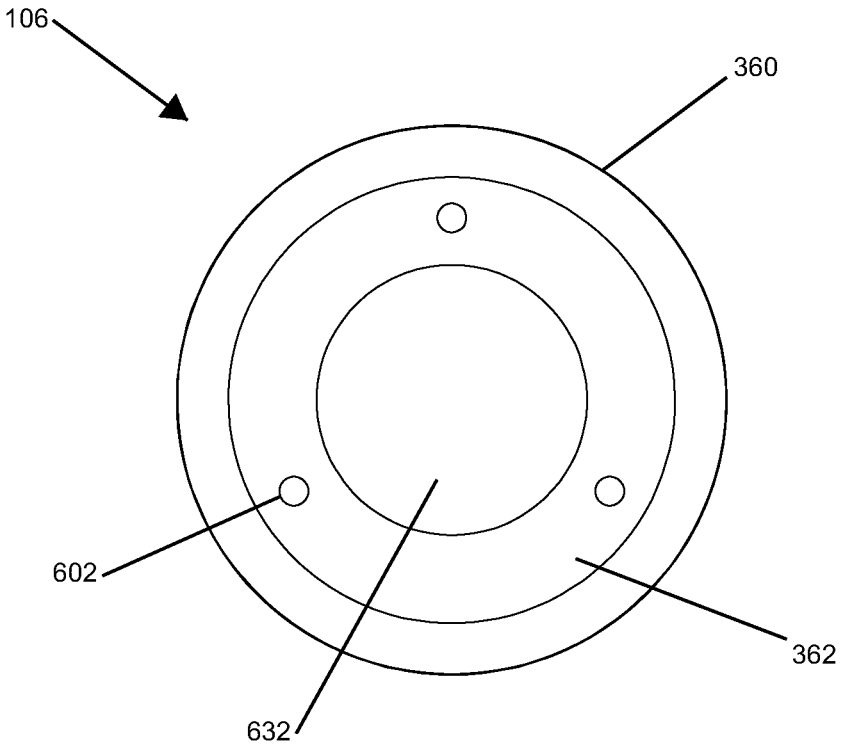
FIG. 6C is a bottom view of the lower portion of the retainer of the apparatus of FIG. 1, such lower portion of the retainer without attachments and removed from the body of the apparatus.

Referring now to FIGS. 6B and 6C, downwardly facing surface 362 of retainer lower portion 106 includes a plurality of semi-spherical protrusions 602. Protrusions 602 are provided to allow retainer 109 and any attachments 108 coupled thereto to be removed from body 102 and attractively displayed alone. That is, the protrusions 602 of retainer 109 may be rested upon a substantially horizontal surface such as a table, desk, shelf, or the like to facilitate display of any attachments 108 coupled to the retainer 109 associated with protrusions 602. Although three (3) protrusions are illustrated in the depicted embodiment of the present invention, protrusions may be omitted or a varying quantity of protrusions may be substituted without departing from the scope of the present invention. Similarly, although semi-spherical protrusions are depicted, protrusions having varying shapes may be substituted.

As seen in FIG. 6B, the topmost edge of outwardly facing surface 360 of retainer lower portion 106 transitions at corner 604 and converges radially inward in a substantially horizontal manner to form ledge 606. At inner corner 608, surface 610 begins. This surface proceeds axially upward at a substantially fixed diameter until upper corner 612, at which the surface proceeds radially inward in a substantially horizontal manner forming upper ledge 614. Upper ledge 614 is also depicted in FIG. 6A. Also, retainer lower portion 106 has a centrally located upper cylindrical aperture 616 bounded by a substantially cylindrical inner wall 620. Wall 620 converges axially downward until transition 622, at which it converges radially inward and axially downward until transition 624. At transition 624, the surface converges radially inward, thereby forming substantially horizontal floor 626. Floor 626 proceeds radially inward until corner 628, at which it intersects with inner wall 630, which extends axially downward at a substantially fixed radial diameter. At the bottommost end of inner wall 630, wall 630 intersects with downwardly facing surface 362. Inner wall 630 bounds lower cylindrical aperture 632.

Figure 8:
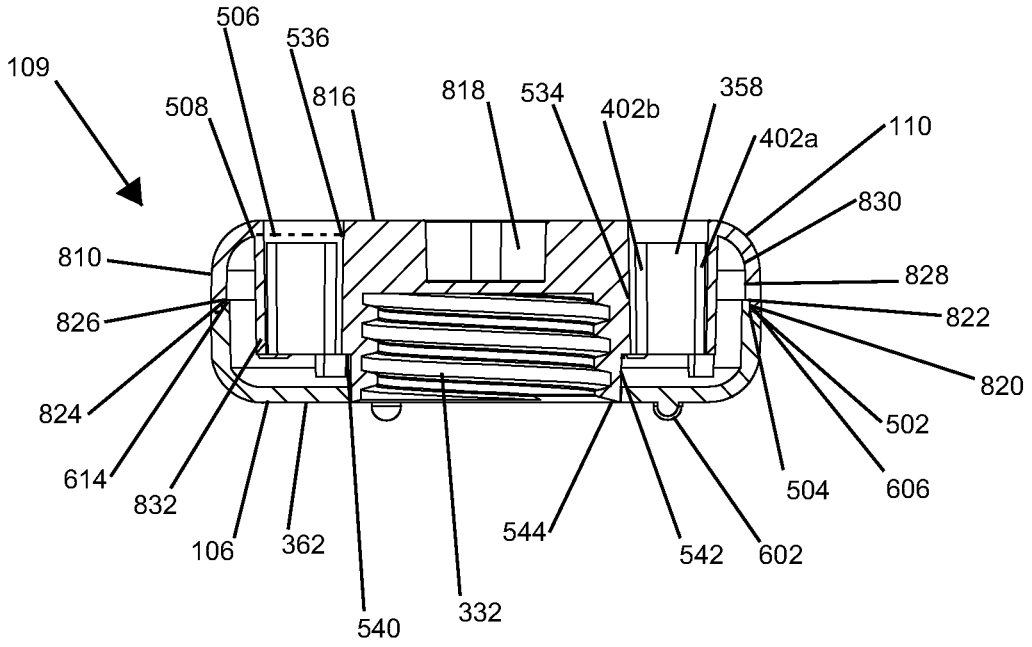
FIG. 8 is a cross sectional view of the retainer of the apparatus of FIG. 1 taken along lines 8-8 of FIG. 4A.

Referring now to FIG. 8, depicted is a cross-sectional view of retainer 109. As seen in FIG. 8, as well as FIG. 3, retainer upper portion 110 is molded to the free state depicted therein. That is, upper retainer portion 110 has outwardly facing surface 810 having a substantially fixed radial distance relative to the axis of retainer 109. The topmost edge of outwardly facing surface 810 curves radially inward and axially upward until it intersects with upwardly facing surface 816.

As best seen in FIG. 4A, upwardly facing surface 816 includes a centrally located cylindrical recess 818 and a plurality of arced recesses 420. Arced recesses 420 are arranged in a circular manner surrounding cylindrical recess 818. Cylindrical recess 818 is optional and it is sized to accept cap 104 for storage. Arced recesses are also optional and are included to lessen the weight of apparatus 100. Although the depicted embodiment includes a plurality of arced recesses 420, in an alternate embodiment, one or more of these recesses are filled with a different material, or the same material as retainer 109, to accommodate printing (e.g., the manufacturer's trademark or logo) on the upwardly facing surface of retainer 109. Upwardly facing surface 816 also includes a plurality of cylindrical receptacles 358, which are arranged equidistantly in a circular manner surrounding arced recesses 420. As best illustrated in FIG. 4A, each receptacle 358 is substantially circular at its topmost end with the exception of two axial channels 402*a* and 402*b* that pass throughout the entire length of receptacle 358 and are located on opposite radial sides of receptacle 358. Axial channel 402*b* is wider than axial channel 402*a* to mate with the widths of attachment protrusions 724*a* and 724*b*, respectively. That is, the widths of channels 402*a* and 402*b* are designed to mate with the widths of attachment protrusions 724*a* and 724*b*, respectively.

Figure 5A:
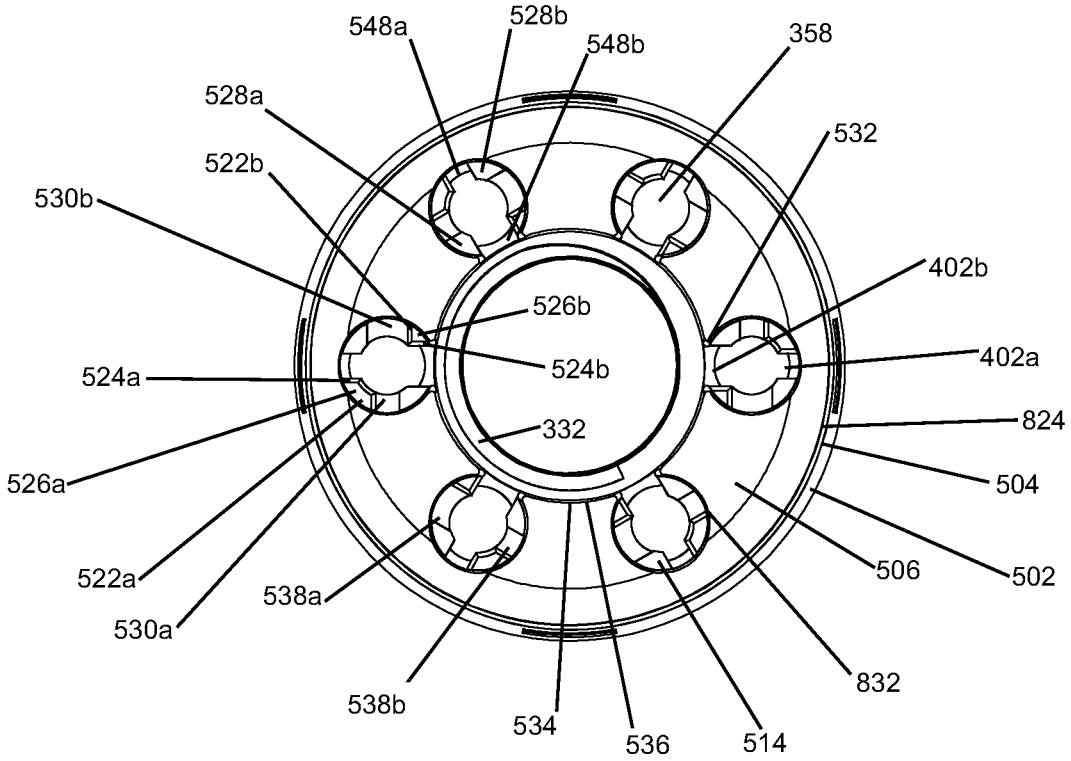
FIG. 5A is a bottom view of the upper portion of the retainer of the apparatus of FIG. 1, such upper portion of the retainer without attachments and removed from the body of the apparatus.
Figure 5B:
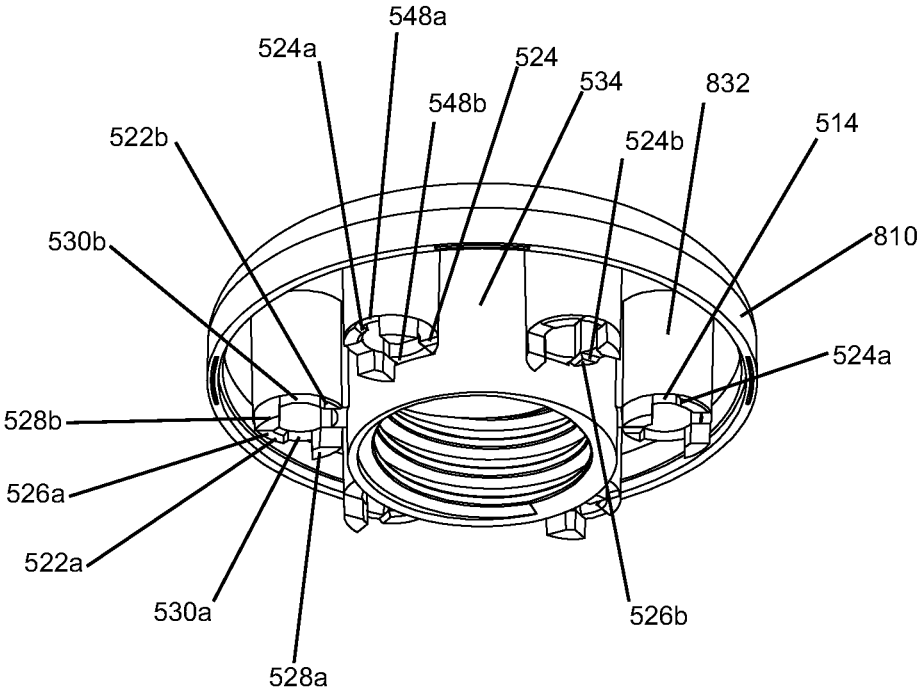
FIG. 5B is a perspective view of the upper portion of the retainer of the apparatus of FIG. 1, such upper portion of the retainer without attachments and removed from the body of the apparatus.

As best seen in FIG. 5A, receptacles 358 are bounded by receptacle walls 832 except at their innermost point along the intersection of axial channel 402*b* and central wall 534. The length of receptacles 358 and receptacle walls 832 extend below the bottommost point of outwardly facing surface 810 as best seen in FIGS. 5B and 8. Axial channels 402 extend axially throughout receptacle 358 and are recessed in receptacle walls 832. Receptacles 358 facilitate retention of attachments 108 as described in greater detail below.

Referring to FIG. 8, the bottommost edge of outwardly facing surface 810 transitions radially inward in a substantially horizontally manner to form downwardly facing surface 502. At the innermost point of edge 502 is corner 504, from which inner wall 820 proceeds axially upward with a substantially fixed diameter until lower corner 822. Downwardly facing ledge 824 proceeds radially inward until inner corner 826, at which inner wall 828 proceeds axially upward at a substantially fixed diameter until point 830 at which it curves radially inward and axially upward. At its innermost point, wall 828 intersects with upper surface 506 at point 508. Upper surface 506 proceeds radially inward in a substantially horizontal manner until corner 536 where it intersects with the topmost portion of central wall 534. Wall 534 is substantially cylindrical in shape. From the bottommost point of wall 534, downwardly facing surface 540 transitions radially inward until it reaches the topmost point of outwardly facing wall 542. Wall 542 extends axially downward with a fixed radial diameter. At its bottommost point, downwardly facing ledge 544 proceeds radially inward until it intersects with helical groove 332.

As best seen in FIGS. 5B and 8, receptacle walls 832 extend axially downward from surface 506. Receptacle walls 832 are substantially cylindrical in shape with the exception of points 532 (See FIG. 5A), at which receptacle walls 832 couple to central wall 534. Now referring to FIG. 5B, at the bottommost edge of receptacle walls 832, bottom surface 514 proceeds axially inward in a substantially horizontal manner until it intersects with the inner surfaces of receptacle walls 832. Each bottom surface 514 includes retainer protrusions 522*a* and 522*b*, retainer recesses 530*a* and 530*b*, stops 528*a* and 528*b*, and axial channel recesses 548*a* and 548*b*. As depicted in FIG. 5A, retainer recess 530*b* and axial channel recess 548*b* are wider than retainer recess 530*a* and axial channel recess 548*a*, respectively, to accommodate the larger size of attachment protrusion 724*b* relative to the size of attachment protrusion 724*a*. The sizes of retainer protrusions 522*b* and stop 528*b* also vary as compared to retainer protrusions 522*a* and stop 528*a*, respectively, due to the sizing constraints placed upon them by retainer recesses 530 and axial channel recesses 548*b*. Retainer protrusions 522*a* and 522*b* include beveled walls 524*a* and 524*b*, respectively, and downwardly facing surfaces 526. Retainer recesses 530*a* and 530*b* include downwardly facing surfaces 538*a* and 538*b*, respectively.

Referring now to FIG. 8, retainer upper portion 110 and retainer lower portion 106 are coupled to each other during manufacturing via, for example, sonic welding. To couple retainer upper portion 110 to retainer lower portion 106, upper ledge 614 of retainer lower portion 106 is slid into retainer upper portion 110 until upper ledge 614 abuts downwardly facing ledge 824 of upper retainer portion 110 and ledge 502 abuts ledge 606. Simultaneously, the bottommost end of outer wall 534 passes through the bottom of aperture 616 into aperture 632. Once the pieces are fitted together, they are then irremovably coupled to each other. However, alternate embodiments of the present invention are envisioned in which retainer 109 is manufactured as a single piece or via the coupling of more than two components.

To couple attachments 108 to retainer 109 and apparatus 100 in a locked manner, the user first aligns attachment protrusions 724*a* and 724*b* with axial channels 402*a* and 402*b*, respectively. Then, the user slides base 704 downwardly through receptacle 358 until protrusions 724 completely exit the bottommost end of receptacle 358. The user then rotates head 702 counterclockwise until attachment protrusions 724*a* and 724*b* snap into retainer recesses 530*a* and 530*b*, respectively. That is, the user rotates head 702 counterclockwise, which in turn rotates attachment protrusions 724 counterclockwise such that latitudinal surfaces 738 located on the left side of each attachment protrusion 724*a* and 724*b* abut respective beveled edges 524 located on the right side of the retainer protrusions 522*a* and 522*b*, respectively. Continued counterclockwise rotation forces attachment protrusions 724*a* and 724*b* to slide under downwardly facing surfaces 526*a* and 526*b*, respectively, of retainer protrusions 522*a* and 522*b*, respectively, and then upward along the respective beveled edge 524 located on the left side of retainer protrusions 522*a* and 522*b*, respectively, until attachment protrusions 724*a* and 724*b* fully pass retainer protrusions 522*a* and 522*b*, respectively, and snap into retainer recesses 530*a* and 530*b*, respectively. The beveling of edges 524 facilitates this motion. When attachment 108 is completely rotated into place, upwardly facing surfaces 732*a* and 732*b* of protrusions 724*a* and 724*b* abut the downwardly facing surfaces 538*a* and 538*b*, respectively, of retainer recesses 530*a* and 530*b*, respectively. Also, the presence of stops 528*a* and 528*b* prevent counterclockwise rotation of attachment 108 beyond the required rotation necessary to couple attachment 108 to retainer 109. The recessed location of attachment protrusions 724*a* and 724*b* between retainer protrusions 522*a* and 522*b*, respectively removably couples attachment 108 to apparatus 100 until a user exerts a clockwise rotational force to attachment 108. This coupling minimizes the potential for an attachment to accidentally dislodge from retainer 109, thereby minimizing the potential for accidental loss of attachment 108. FIG. 4B depicts a top view of an apparatus 100 with six attachments 108 coupled thereto. Although the depicted embodiment requires counterclockwise rotation of attachment 108 to couple it to retainer 109, clockwise rotation may be substituted. Additionally, alternate methods of coupling attachment 108 to retainer 109 and/or apparatus 100 may be substituted without departing from the scope of the present invention.

Removal and unlocking of attachments 108 is accomplished via clockwise motion of attachment 108. When head 702 of attachment 108 is rotated clockwise, attachment protrusions 724 rotate clockwise such that latitudinal surfaces 738 located on the right side of each attachment protrusion 724*a* and 724*b* abut respective beveled edges 524 located on the left side of retainer protrusions 522*a* and 522*b*, respectively. Continued clockwise rotation forces attachment protrusions 724*a* and 724*b* to slide under downwardly facing surfaces 526*a* and 526*b*, respectively, of retainer protrusions 522*a* and 522*b*, respectively, and then upward along the respective beveled edge 524 located on the right side of retainer protrusions 522*a* and 522*b*, respectively, until attachment protrusions 724*a* and 724*b* fully pass retainer protrusions 522*a* and 522*b*, respectively, and return to axial channels 402*a* and 402*b*, respectively. The beveling of edges 524 facilitates this motion. When protrusions 724*a* and 724*b* are completely aligned with axial channels 402*a* and 402*b*, respectively, the user simply slides base 704 out of receptacle 358 until attachment 108 is removed from retainer 109. Although the depicted embodiment requires clockwise rotation of attachment 108 to remove it from retainer 109, clockwise rotation may be substituted. Additionally, alternate methods of removing attachment 108 from retainer 109 and/or apparatus 100 may be substituted without departing from the scope of the present invention. In the depicted embodiment, each receptacle 358 is designed to couple with one attachment 108, however, alternate embodiments of the present invention are envisioned in which multiple attachments may be coupled to a single receptacle and/or multiple receptacles may be coupled to a single attachment.

As best seen in FIG. 3, the hollow interior of second body section 304 allows one or more attachments 108 to be stored therein. To use the interior of second body section 304 for this purpose, retainer 109 is removed from body 102 via unthreading threads 330 from helical groove 332. Once retainer 109 is fully unthreaded, aperture 338 is accessible. To store one or more attachments 108 inside second body section 304, a user simply passes attachment 108 through aperture 338 with its cylindrical base 704 leading. Once the desired quantity of attachments 108 have been placed in the storage area, retainer 109 is replaced and secured by re-threading threads 330 into helical groove 332. Although the embodiment of the present invention depicted in FIG. 3 shows storage of three (3) attachments 108, storage for varying quantities of attachments may be substituted without departing from the scope of the present invention.

Referring now to FIGS. 10A-10D, depicted is a perspective view of retainer 1000 in accordance with an alternate embodiment of the present invention. Retainer 1000 is substantially square in shape and has four identical sides 1004. Each side 1004 is in the form of a substantially planar square. Edges 1006 bound each side 1004 as well as top 1016 and bottom 1018. Edges 1006 curve outward and inward as they extend from the bounded area to intersect with the edges 1006 that bound adjacent sides 1004, top 1016, and bottom 1018. Corners 1008 are located at the longitudinal ends of each edge 1006. Corners 1008 are substantially triangular in shape with each point of the triangular shape curving inward such that the perimeter of corners 1008 intersects fluidly with all adjacent edges 1006 and such that corners 1008 are substantially convex.

Top 1016 and bottom 1018 are identical to sides 1004 except for the passage of cylindrical receptacle 1058 through the approximate midpoint thereof. Substantially cylindrical receptacle 1058 is substantially identical to receptacle 358 as depicted and described above in greater detail with respect to FIGS. 1-9. Specifically, as best seen in the top view of FIG. 10B, receptacle 1058 includes axial channels 1002*a* and 1002*b* that are substantially identical to channels 402*a* and 402*b*. Also, as best seen in the cross-sectional view of FIG. 10C, receptacle 1058 includes an identical cross-sectional configuration as receptacle 358 as discussed above. As also shown, the bottommost end of receptacle 1058 passes through the approximate midpoint of bottom 1018.

Figure 10A:
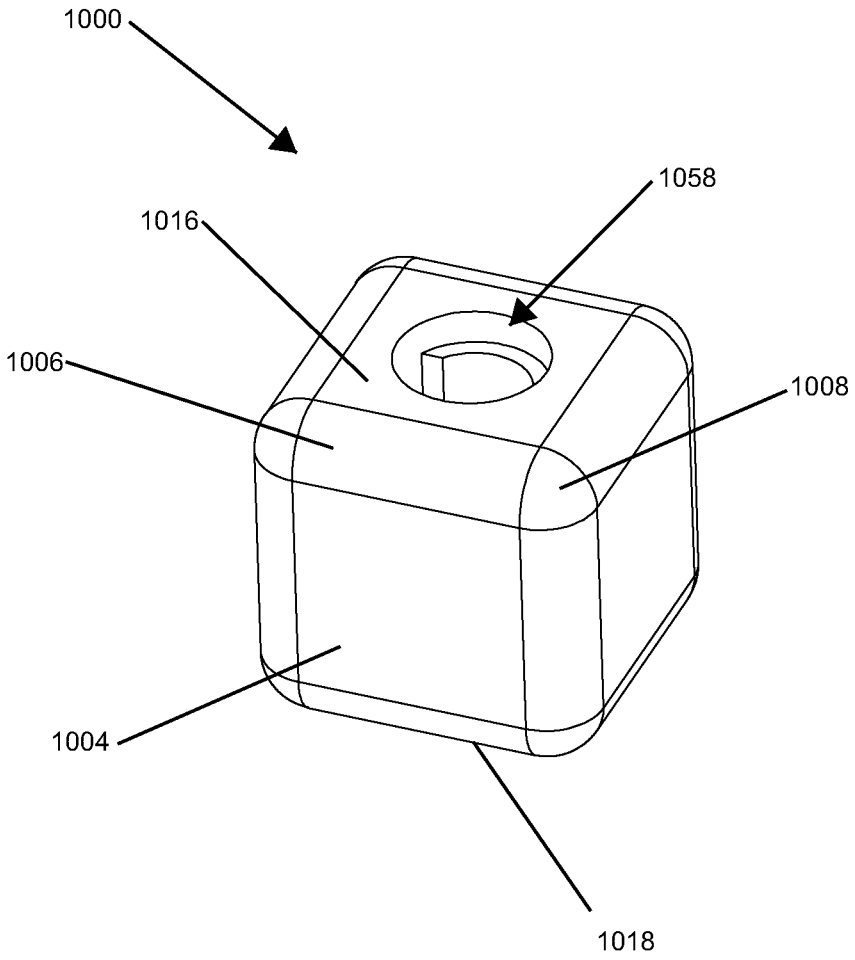
FIG. 10A is a perspective view of a retainer in accordance with an alternate embodiment of the present invention, such retainer without an attachment.
Figure 10B:
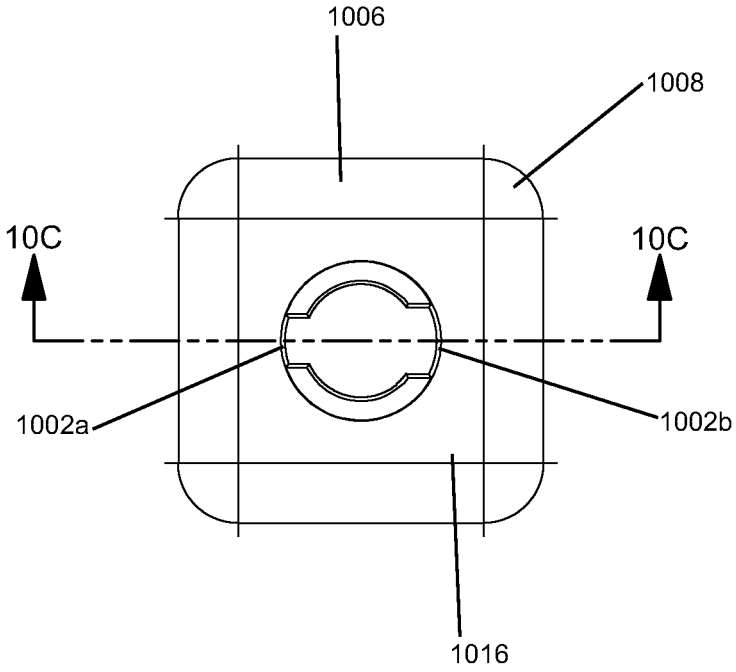
FIG. 10B is a top view of the retainer of FIG. 10A.
Figure 10C:
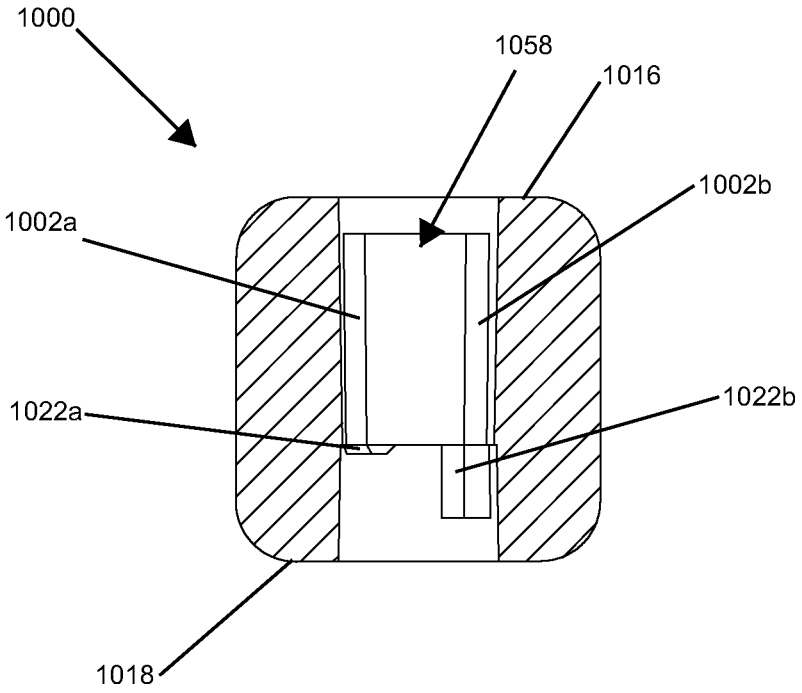
FIG. 10C is a cross-sectional view of the retainer of FIG. 10A taken along lines 10C-10C of FIG. 10B.
Figure 10D:
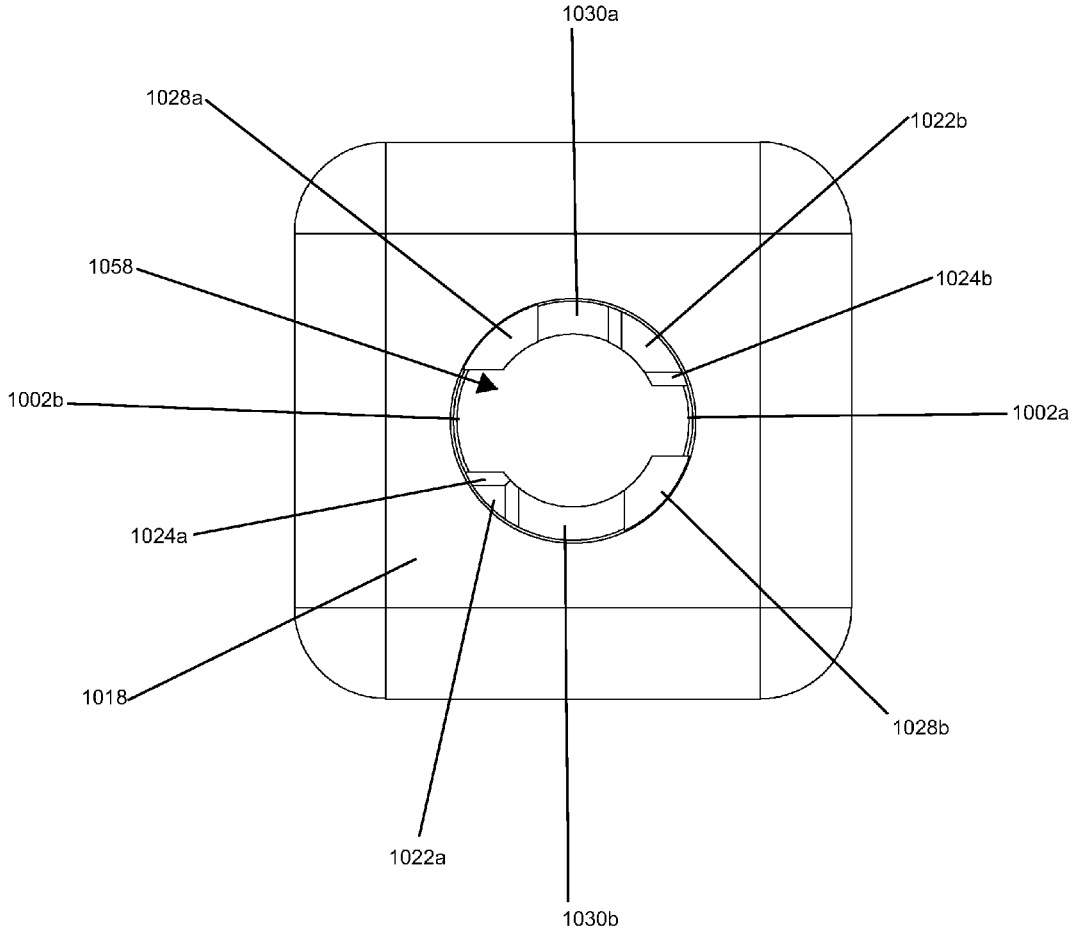
FIG. 10D is a bottom view of the retainer of FIG. 10A.

As best seen in FIG. 10D, receptacle 1058 includes retainer protrusions 1022*a* and 1022*b*, retainer recesses 1030*a* and 1030*b*, stops 1028*a* and 1028*b*, and axial channels 1002*a* and 1002*b*, which are substantially identical to retainer protrusions 522*a* and 522*b*, retainer recesses 530*a* and 530*b*, stops 528*a* and 528*b*, and axial channels 402*a* and 402*b* as discussed in greater detail above. That is, as seen in FIGS. 10A-10D, receptacle 1058 is substantially identical to receptacle 358. This allows attachments 108 to be coupled to retainer 1000 in the same manner with which they are coupled to apparatus 100 as discussed in greater detail above. This allows the same attachments 108 to be interchangeably coupled to a plurality of apparatus 100, retainers 1000, and/or other apparatus having a compatible receptacle such as receptacle 358.

Figure 11A:
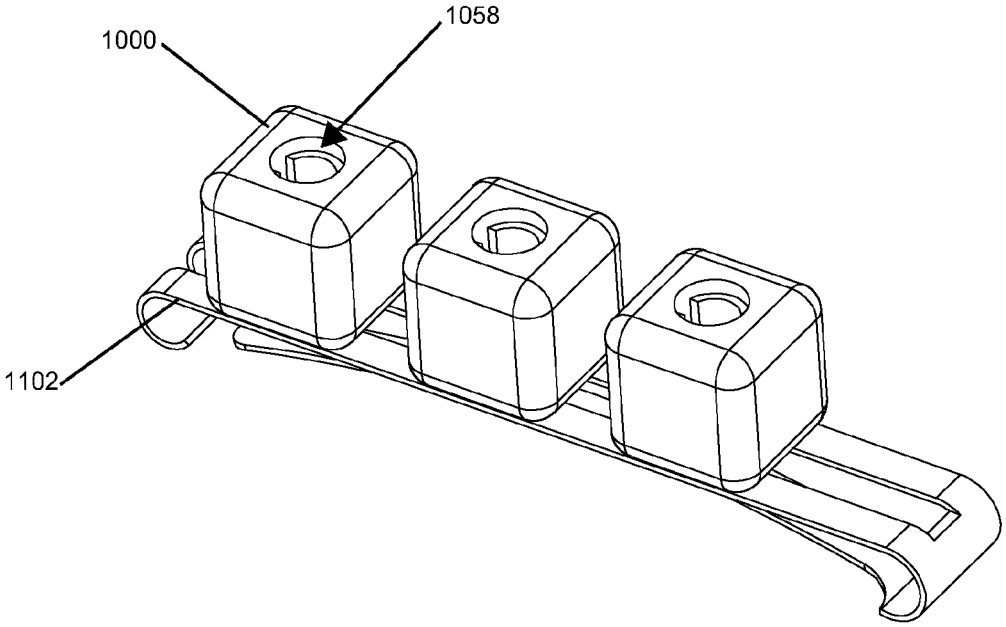
FIG. 11A is a perspective view of a plurality of the retainers of FIGS. 10A-10D attached to a hair barrette such that the retainer receptacles are located vertically in accordance with an alternate embodiment of the present invention.

Turning now to FIG. 11A, depicted is a perspective view of a plurality of retainers 1000 of FIGS. 10A-10D attached to hair barrette 1102 such that receptacles 1058 are located vertically in accordance with an alternate embodiment of the present invention. One or more retainers 1000 may be attached to hair barrette 1102 in any manner including, but not limited to, via an adhesive. In one embodiment of the present invention, retainers 1000 are attached to hair barrette 1102 by the manufacturer of the hair barrette prior to sale to the end user. Alternatively, retainers 1000 may be sold individually to end users for attachment to any standard commercially available hair barrette by the user. In the latter embodiment, a user may arrange retainers 1000 in accordance with their preference. Since retainers 1000 include receptacle 1058, which is substantially identical to receptacle 358, retainers 1000, and therefore hair barrette 1102, are capable of accepting and retaining a plurality of attachments compatible with retainer 1000 including, but not limited to, attachments 108 as described in greater detail above with respect to FIG. 7. This allows hair barrettes 1102 to retain and display exchangeable attachments in accordance with an object of the present invention as also discussed in greater detail above. Although three (3) retainers are depicted, varying quantities of retainers may be substituted without departing from the scope of the invention. In addition, alternate types of hair barrettes may be substituted.

Figure 11B:
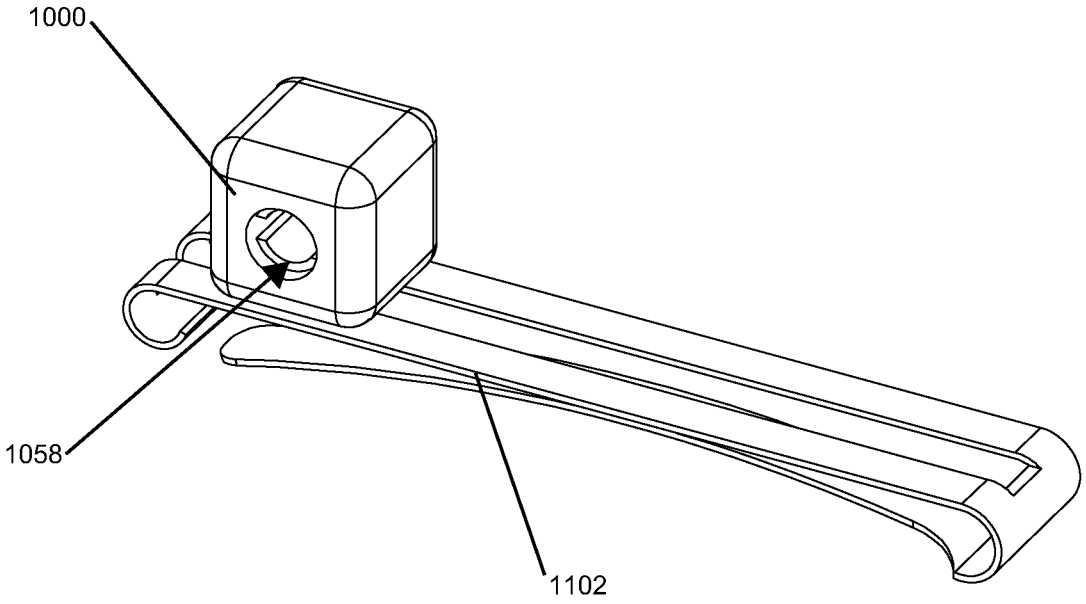
FIG. 11B is a perspective view of one of the retainers of FIGS. 10A-10D attached to a hair barrette such that the retainer receptacle is located horizontally in accordance with an alternate embodiment of the present invention.

Depicted in FIG. 11B is a perspective view of one of the retainers of FIGS. 10A-10D attached to a hair barrette such that the retainer receptacle is located horizontally in accordance with an alternate embodiment of the present invention. That is, retainer 1000 has been rotated ninety degrees forward prior to attachment to hair barrette 1102. Although retainer 1000 is depicted as rotated forward, retainer 1000 may also be rotated backward or sideways in accordance with the present invention. As discussed above with respect to FIG. 11A, one or more retainers 1000 may be attached to hair barrette 1102 in any manner including, but not limited to, via an adhesive, and retainers 1000 may be attached to hair barrette 1102 by the manufacturer of the hair barrette or the end user. Since retainers 1000 include receptacle 1058, which is substantially identical to receptacle 358, retainers 1000, and therefore hair barrette 1102, are capable of accepting and retaining a plurality of attachments compatible with retainer 1000 including, but not limited to, attachments 108 as described in greater detail above with respect to FIG. 7. However, horizontally located receptacles may also be used for attachment of angled attachments 1208 as described in greater detail below with respect to FIG. 12. This allows hair barrettes 1102 to retain and display exchangeable attachments in accordance with an object of the present invention as also discussed in greater detail above. Although one (1) retainer is depicted, varying quantities of retainers may be substituted without departing from the scope of the invention. In addition, alternate types of hair barrettes may be substituted.

Figure 12:
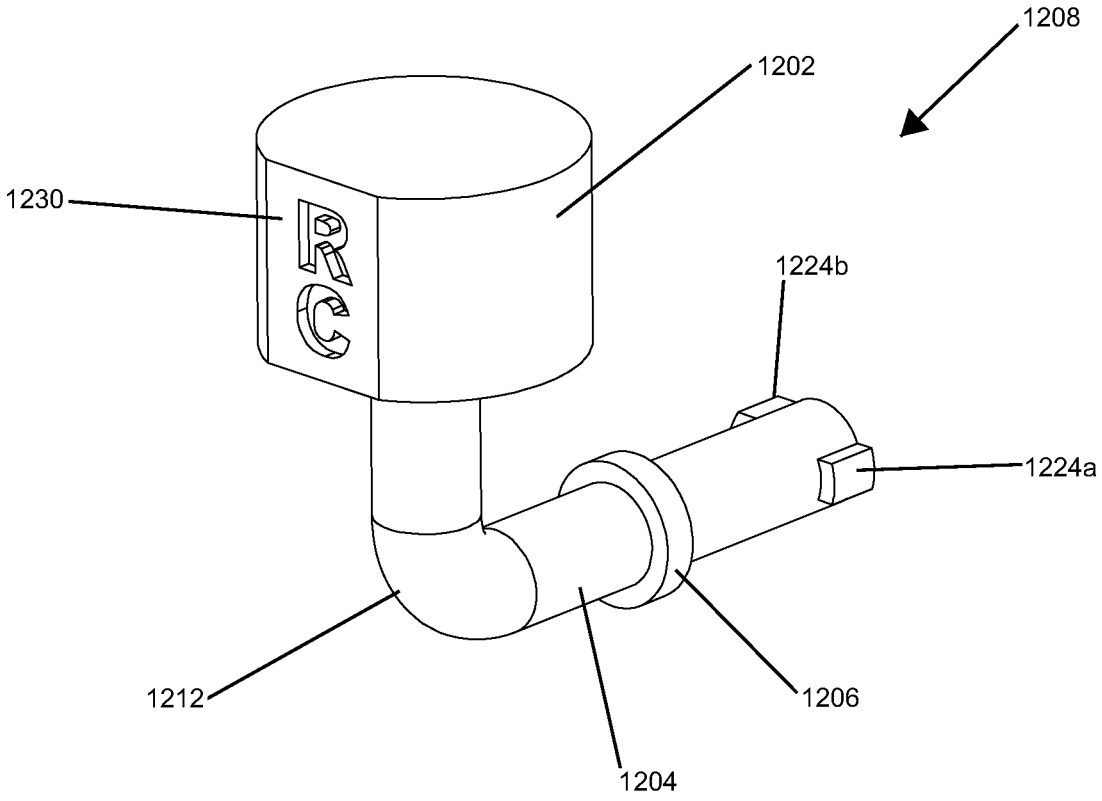
FIG. 12 is a perspective view of a second attachment in accordance with an alternate embodiment of the present invention.

Now referring to FIG. 12, depicted is a perspective view of a second attachment 1208 in accordance with an alternate embodiment of the present invention. Attachment 1200 includes substantially cylindrical head 1202, which is substantially identical to head 702 of attachment 108 as described in greater detail above. Head 1202 is coupled to a substantially cylindrical base 1204, the latter of which includes bead 1206, protrusion 1224*a*, and protrusion 1224*b*. These are substantially identical to bead 706, protrusion 724*a*, and protrusion 724*b*, respectively. Base 1204 is also substantially identical to base 704 with the exception of bend 1212. The identical nature of the base of attachment 1208 to the base of attachment 108 allows attachment 1208 to be coupled to a receptacle similar to receptacle 358 in the same manner with which attachment 108 is coupled to a receptacle 358 as discussed in greater detail above. Bend 1212 creates a ninety degree angle in attachment 1208. When attachment 1208 is coupled to a retainer 1000 installed such that its retainer receptacle is horizontally located, the angle of bend 1212 causes outwardly facing surface 1230 to be in an upright orientation, which facilitates viewing thereof when attachment 1208 is installed in retainer 1000 having a horizontally located receptacle. Although head 1202 is shown as cylindrical, alternate embodiments of head 1202 may be substituted without departing from the scope of the present invention.

Figure 13:
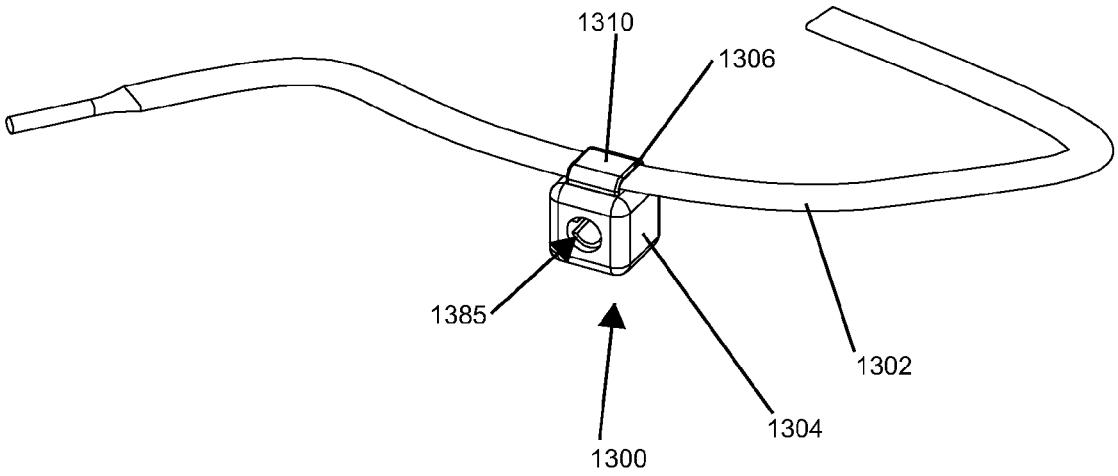
FIG. 13 is a perspective view of an alternate retainer coupled to a shoe lace in accordance with an alternate embodiment of the present invention.

Depicted in FIG. 13 is a perspective view of an alternate retainer 1300 coupled to a shoe lace 1302 in accordance with an alternate embodiment of the present invention. Retainer 1300 is substantially identical to retainer 1000 of FIGS. 10A-10D except that it includes an integral retainer bail 1310 or other similar mechanism. Bail 1310 is attached to one side 1304 of retainer 1300 to allow it to be coupled to elongated items having a relatively narrow width such as shoe lace 1302. Bail 1310 is semi-hexagonal and has a width approximately equal to the width of side 1304. The inclusion of bail 1304 in retainer 1300 creates a channel 1306 through which shoe lace 1302 may be passed in order to couple retainer 1300 thereto. In the depicted embodiment, bail 1310 is coupled to retainer 1300 such that retainer receptacle 1385 is located horizontally when retainer 1300 is coupled to shoe lace 1302. Receptacle 1358 is substantially identical to receptacle 358 as discussed in greater detail above, therefore, inclusion of receptacle 1358 in retainer 1300 allows retainer 1300, and therefore shoe lace 1302, to accept and retain a plurality of attachments compatible with retainer 1300 including, but not limited to, attachments 108 as described in greater detail above with respect to FIG. 7 and angled attachments 1208 as described in greater detail above with respect to FIG. 12. This allows shoe laces 1302 to retain and display exchangeable attachments in accordance with an object of the present invention as also discussed in greater detail above. Although one (1) retainer is depicted, varying quantities of retainers may be substituted without departing from the scope of the invention. In addition, alternate types of shoe laces may be substituted.

Figure 14A:
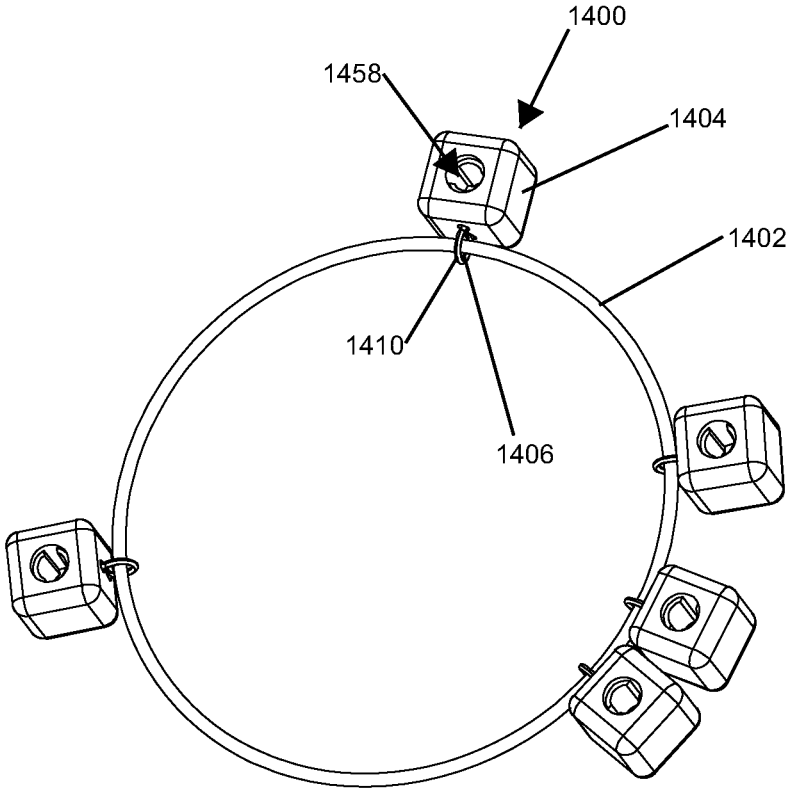
FIG. 14A is a perspective view of a plurality of alternate retainers coupled to a bracelet in accordance with an alternate embodiment of the present invention.

Turning now to FIG. 14A, depicted is a perspective view of an alternate retainer 1400 coupled to a bracelet 1402 in accordance with an alternate embodiment of the present invention. Retainer 1400 is substantially identical to retainer 1000 of FIGS. 10A-10D except that it includes an integral retainer bail 1410 or other similar mechanism. Bail 1410 is attached to one side 1404 of retainer 1400 to allow it to be coupled to elongated items having a relatively narrow width such as bracelet 1402. Bail 1410 is in the form of a ring portion wherein the remaining portion of the ring passes through retainer side 1404. The inclusion of bail 1404 in retainer 1400 creates an aperture 1406 through which bracelet 1402 may be passed in order to couple retainer 1400 thereto. In the depicted embodiment, bail 1410 is coupled to retainer 1400 such that retainer receptacle 1485 is located horizontally when retainer 1400 is coupled to bracelet 1402. Receptacle 1458 is substantially identical to receptacle 358 as discussed in greater detail above, therefore, inclusion of receptacle 1458 in retainer 1400 allows retainer 1400, and therefore bracelet 1402, to accept and retain a plurality of attachments compatible with retainer 1400 including, but not limited to, attachments 108 as described in greater detail above with respect to FIG. 7 and angled attachments 1208 as described in greater detail above with respect to FIG. 12. This allows bracelet 1402 to retain and display exchangeable attachments in accordance with an object of the present invention as also discussed in greater detail above. Although five (5) retainers are depicted, varying quantities of retainers may be substituted without departing from the scope of the invention. In addition, alternate types of bracelets or other jewelry (e.g., anklets, necklaces, etc.) may be substituted.

Figure 14B:
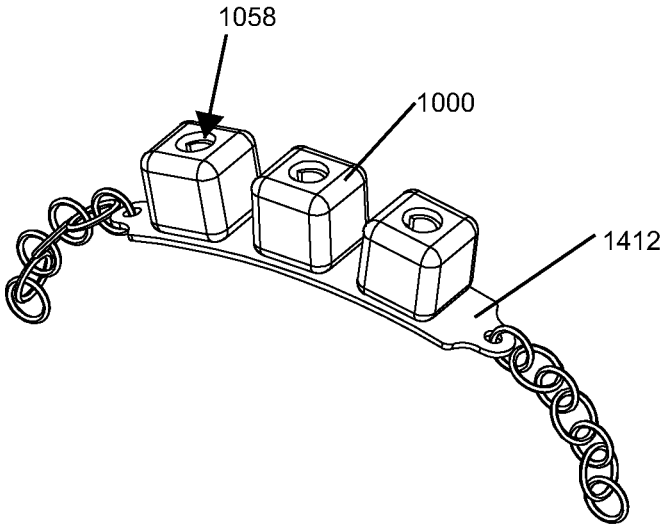
FIG. 14B is a perspective view of a plurality of the retainers of FIGS. 10A-10D coupled to a bracelet in accordance with an alternate embodiment of the present invention.

Depicted in FIG. 14B is a perspective view of a plurality of retainers 1000 of FIGS. 10A-10D attached to bracelet 1412 such that receptacles 1058 are located vertically in accordance with an alternate embodiment of the present invention. One or more retainers 1000 may be attached to bracelet 1406 in any manner including, but not limited to, via an adhesive. In one embodiment of the present invention, retainers 1000 are attached to bracelet by the manufacturer of the bracelet prior to sale to the end user. Alternatively, retainers 1000 may be sold individually to end users for attachment to any standard commercially available bracelet by the user. In the latter embodiment, a user may arrange retainers 1000 in accordance with their preference. Since retainers 1000 include receptacle 1058, which is substantially identical to receptacle 358, retainers 1000, and therefore bracelet 1412, are capable of accepting and retaining a plurality of attachments compatible with retainer 1000 including, but not limited to, attachments 108 as described in greater detail above with respect to FIG. 7. This allows bracelet 1406 to retain and display exchangeable attachments in accordance with an object of the present invention as also discussed in greater detail above. Although three (3) retainers are depicted, varying quantities of retainers may be substituted without departing from the scope of the invention. In addition, alternate types of bracelets or other jewelry may be substituted.

Figure 15:
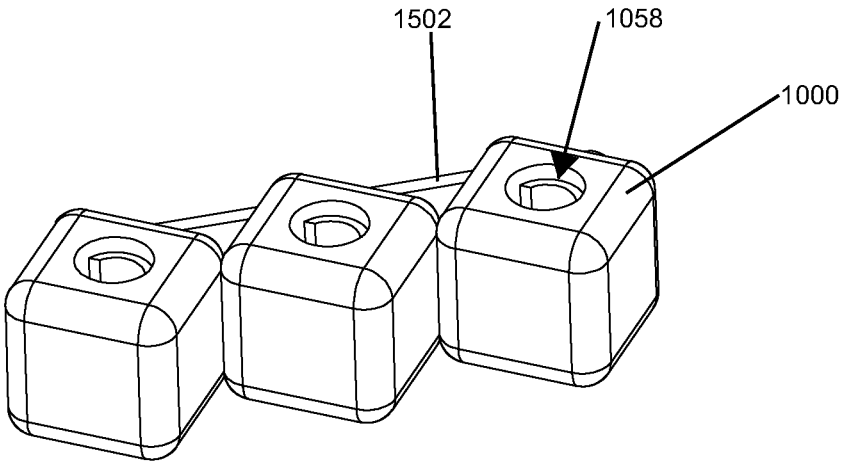
FIG. 15 is a perspective view of a plurality of the retainers of FIGS. 10A-10D coupled to a brooch in accordance with an alternate embodiment of the present invention.

Turning to FIG. 15, depicted is a perspective view of a plurality of retainers 1000 of FIGS. 10A-10D attached to brooch 1502 such that receptacles 1058 are located vertically in accordance with an alternate embodiment of the present invention. One or more retainers 1000 may be attached to brooch 1502 in any manner including, but not limited to, via an adhesive. In one embodiment of the present invention, retainers 1000 are attached to brooch by the manufacturer of the brooch prior to sale to the end user. Alternatively, retainers 1000 may be sold individually to end users for attachment to any standard commercially available brooch by the user. In the latter embodiment, a user may arrange retainers 1000 in accordance with their preference. Since retainers 1000 include receptacle 1058, which is substantially identical to receptacle 358, retainers 1000, and therefore brooch 1502, are capable of accepting and retaining a plurality of attachments compatible with retainer 1000 including, but not limited to, attachments 108 as described in greater detail above with respect to FIG. 7. This allows brooch 1502 to retain and display exchangeable attachments in accordance with an object of the present invention as also discussed in greater detail above. Although three (3) retainers are depicted, varying quantities of retainers may be substituted without departing from the scope of the invention. In addition, alternate types of brooches or other jewelry may be substituted.

Figure 16:
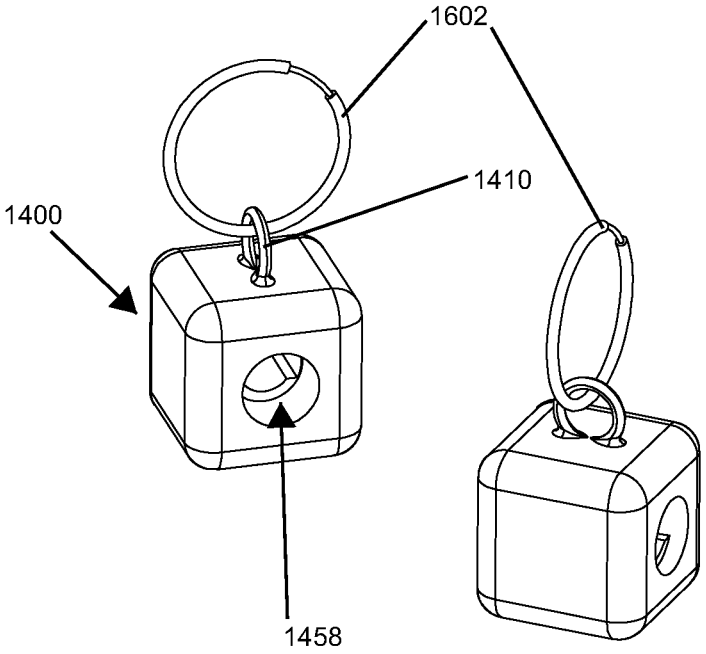
FIG. 16 is a perspective view of a pair of alternate retainers individually coupled to each of a pair of earrings in accordance with an alternate embodiment of the present invention.

Turning now to FIG. 16, depicted is a perspective view of a pair of retainers 1400 of FIG. 14A individually coupled to each of a pair of earrings 1602 such that the retainer receptacle is located horizontally in accordance with an alternate embodiment of the present invention. That is, retainer receptacle 1458 is rotated ninety degrees forward relative to its respective earring 1602. Although retainer receptacle 1458 is depicted as rotated forward, retainer receptacle 1458 may also be rotated sideways in accordance with the present invention. Retainer 1400 is coupled to earring 1602 by passing earring 1602 through retainer bail 1410. Since each retainer 1400 includes a receptacle 1458, which is substantially identical to receptacle 358, retainers 1400, and therefore earring 1602, are capable of accepting and retaining a plurality of attachments compatible with retainer 1400 including, but not limited to, attachments 108 as described in greater detail above with respect to FIG. 7. However, horizontally located receptacles may also be used for attachment of angled attachments 1208 as described in greater detail above with respect to FIG. 12. This allows earring 1602 to retain and display exchangeable attachments in accordance with an object of the present invention as also discussed in greater detail above. Although one (1) retainer per earring is depicted, varying quantities of retainers may be substituted without departing from the scope of the invention. In addition, alternate types of earrings may be substituted.

Figure 17:
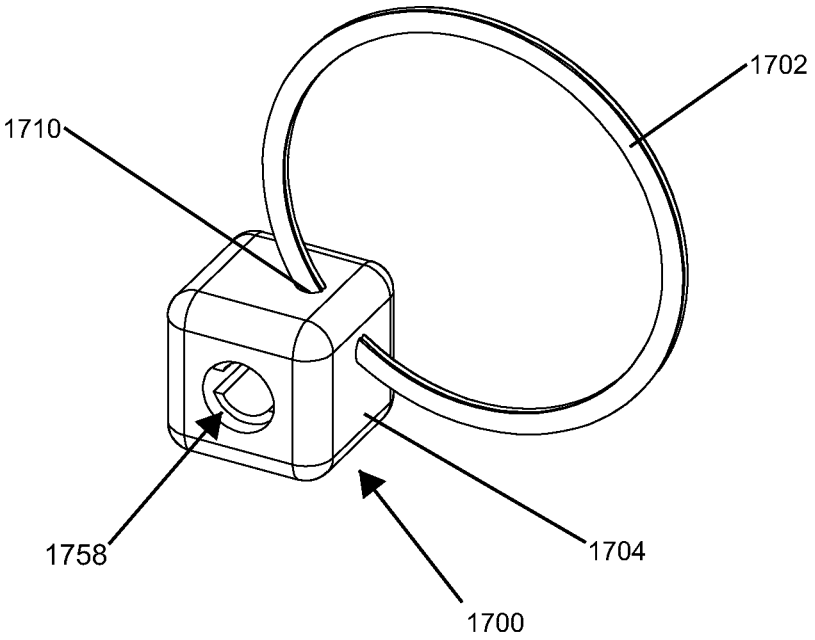
FIG. 17 is a perspective view of an alternate retainer coupled to a keychain in accordance with an alternate embodiment of the present invention.

Turning now to FIG. 17, depicted is a perspective view of an alternate retainer 1700 including an integral keychain 1702 in accordance with an alternate embodiment of the present invention. Retainer 1700 is coupled to keychain 1702 such that the retainer receptacle is located horizontally relative to keychain 1702. That is, retainer receptacle 1758 is rotated ninety degrees forward relative to keychain 1702. Although retainer receptacle 1758 is depicted as rotated forward, retainer receptacle 1758 may also be rotated sideways in accordance with the present invention. In the depicted embodiment; retainer 1700 includes a channel 1710 through which keychain 1702 passes in order to couple retainer 1700 to keychain 1702. Channel 1710 passes through two sides 1704 of retainer 1700 and is sized to accommodate passage of a key ring therethrough. Channel 1710 passes through retainer 1700 in a location that does not disrupt the integrity of centrally located receptacle 1758. Since retainer 1700 includes receptacle 1758, which is substantially identical to receptacle 358, retainer 1700, and therefore keychain 1702, are capable of accepting and retaining a plurality of attachments compatible with retainer 1700 including, but not limited to, attachments 108 as described in greater detail above with respect to FIG. 7. However, horizontally located receptacles may also be used for attachment of angled attachments 1208 as described in greater detail above with respect to FIG. 12. This allows keychain 1702 to retain and display exchangeable attachments in accordance with an object of the present invention as also discussed in greater detail above. Although one (1) retainer is depicted, varying quantities of retainers may be substituted without departing from the scope of the invention. In addition, alternate types of keychains or other jewelry may be substituted.

Figure 18:
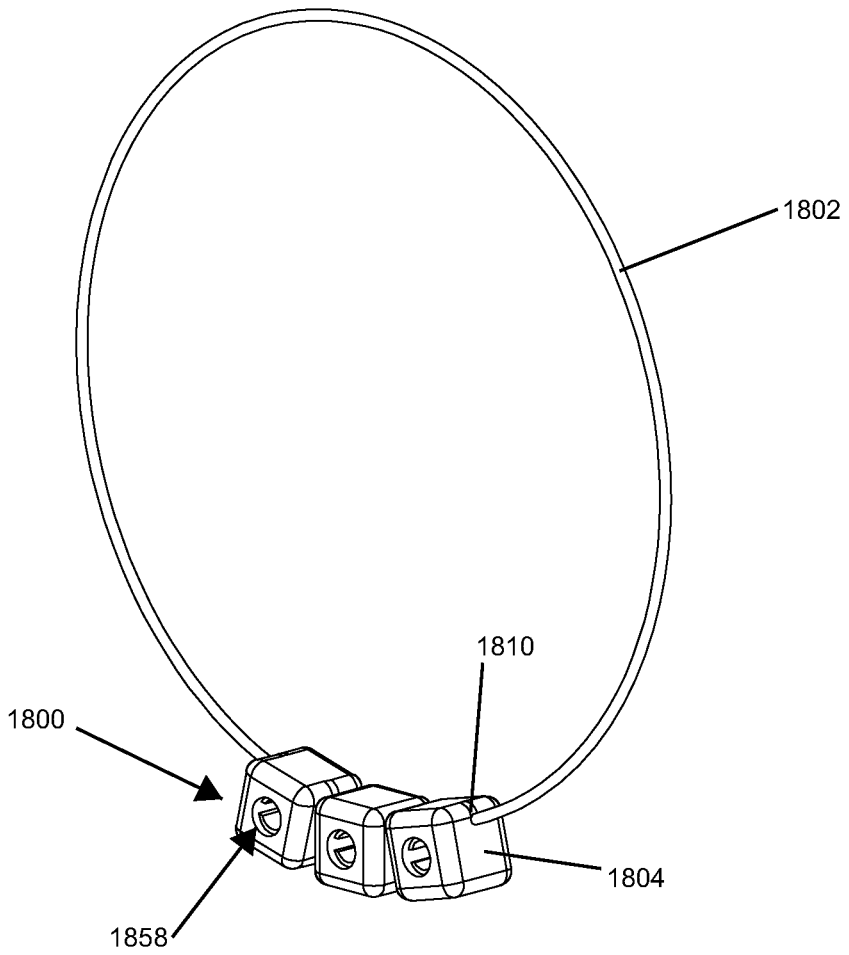
FIG. 18 is a perspective view of a plurality of alternate retainers configured to create a necklace in accordance with an alternate embodiment of the present invention.

Turning now to FIG. 18, depicted is a perspective view of a plurality of alternate retainers 1800 configured to create a necklace in accordance with an alternate embodiment of the present invention. Retainers 1800 are coupled to necklace 1802 such that retainer receptacles 1858 are located horizontally relative to necklace 1802. That is, retainer receptacles 1858 are rotated ninety degrees forward relative to necklace 1802. Although retainer receptacles 1858 are depicted as rotated forward relative to necklace 1802, one or more of retainer receptacles 1858 may also be rotated sideways in accordance with the present invention. In the depicted embodiment; retainers 1800 include channels 1810 through which necklace 1802 passes in order to couple retainers 1800 to necklace 1802. Channels 1810 pass through two opposing sides 1804 of retainers 1800 and they are sized to accommodate passage of a necklace therethrough. Channels 1810 pass through retainers 1800 in a location that does not disrupt the integrity of centrally located receptacle 1858. Since retainers 1800 include receptacles 1858, which are substantially identical to receptacle 358, retainers 1800, and therefore necklace 1802, are capable of accepting and retaining a plurality of attachments compatible with retainer 1800 including, but not limited to, attachments 108 as described in greater detail above with respect to FIG. 7. However, horizontally located receptacles may also be used for attachment of angled attachments 1208 as described in greater detail above with respect to FIG. 12. This allows necklace 1802 to retain and display exchangeable attachments in accordance with an object of the present invention as also discussed in greater detail above. Although three (3) retainers are depicted, varying quantities of retainers may be substituted without departing from the scope of the invention. In addition, alternate types of necklaces or other jewelry may be substituted.

Figure 19A:
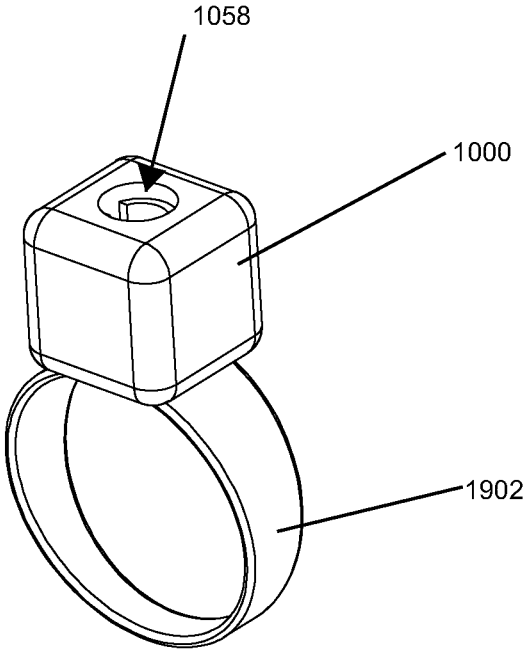
FIG. 19A is a perspective view of the retainer of FIGS. 10A-10D attached to a ring such that the retainer receptacle is located vertically in accordance with an alternate embodiment of the present invention.

Turning now to FIG. 19A, depicted is a perspective view of a retainer 1000 of FIGS. 10A-10D attached to ring 1902 such that receptacle 1058 is located vertically in accordance with an alternate embodiment of the present invention. One or more retainers 1000 may be attached to ring 1902 in any manner including, but not limited to, via an adhesive. In one embodiment of the present invention, retainer 1000 is attached to ring 1902 by the manufacturer of the ring prior to sale to the end user. Alternatively, retainers 1000 may be sold individually to end users for attachment to any standard commercially available ring by the user. In the latter embodiment, a user may arrange one or more retainers 1000 in accordance with their preference. Since retainer 1000 includes receptacle 1058, which is substantially identical to receptacle 358, retainer 1000, and therefore ring 1902, is capable of accepting and retaining a plurality of attachments compatible with retainer 1000 including, but not limited to, attachment 108 as described in greater detail above with respect to FIG. 7. This allows ring 1902 to retain and display exchangeable attachments in accordance with an object of the present invention as also discussed in greater detail above. Although one (1) retainer is depicted, varying quantities of retainers may be substituted without departing from the scope of the invention. In addition, alternate types of rings may be substituted.

Figure 19B:
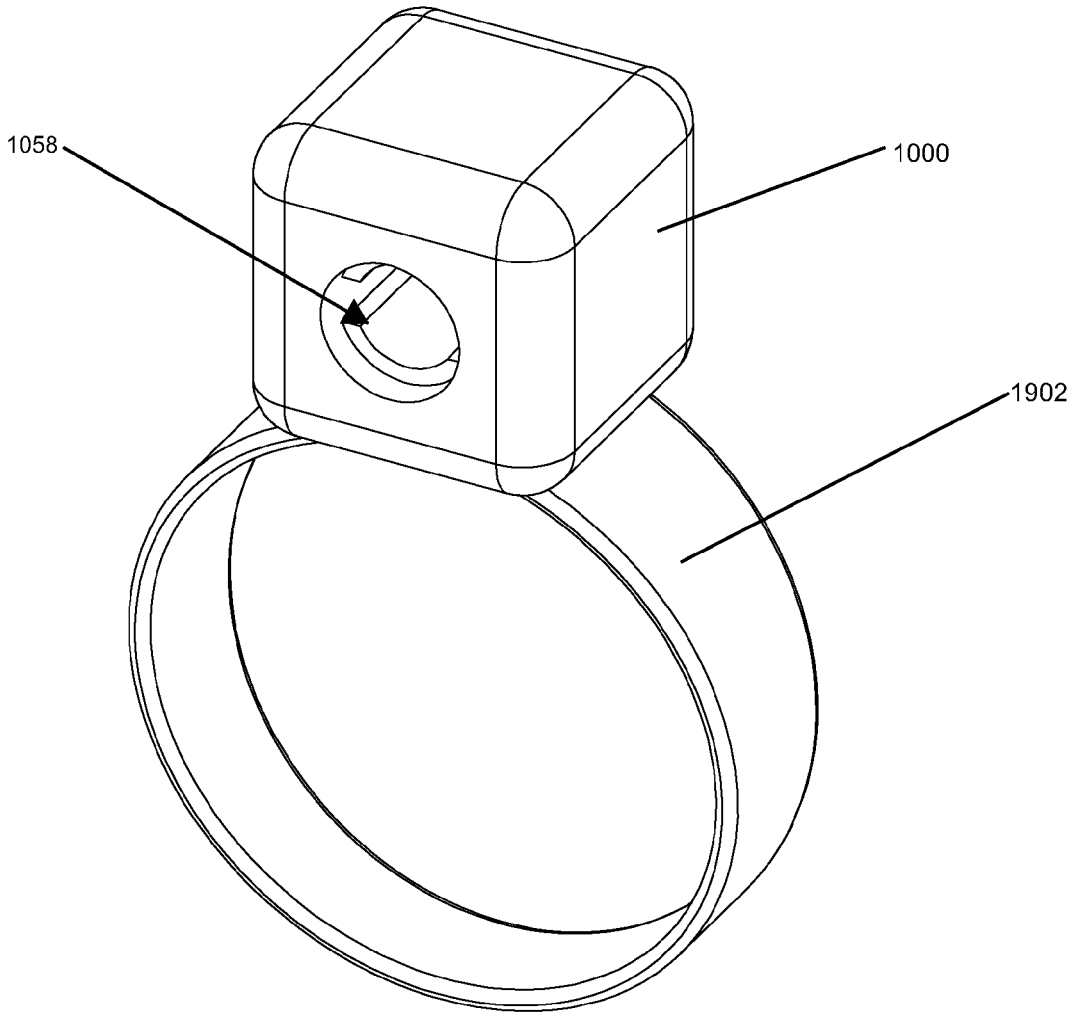
FIG. 19B is a perspective view of the retainer of FIGS. 10A-10D attached to a ring such that the retainer receptacle is located horizontally in accordance with an alternate embodiment of the present invention.

Depicted in FIG. 19B is a perspective view of one of the retainers of FIGS. 10A-10D attached to a ring such that the retainer receptacle is located horizontally in accordance with an alternate embodiment of the present invention. That is, retainer 1000 has been rotated ninety degrees forward prior to attachment to ring 1902. Although retainer 1000 is depicted as rotated forward, retainer 1000 may also be rotated backward or sideways in accordance with the present invention. As discussed above with respect to FIG. 19A, one or more retainers 1000 may be attached to ring 1902 in any manner including, but not limited to, via an adhesive, and retainers 1000 may be attached to ring 1902 by the manufacturer of the ring or the end user. Since retainers 1000 include receptacle 1058, which is substantially identical to receptacle 358, retainers 1000, and therefore ring 1902, are capable of accepting and retaining a plurality of attachments compatible with retainer 1000 including, but not limited to, attachments 108 as described in greater detail above with respect to FIG. 7. However, horizontally located receptacles may also be used for attachment of angled attachments 1208 as described in greater detail below with respect to FIG. 12. This allows ring 1902 to retain and display exchangeable attachments in accordance with an object of the present invention as also discussed in greater detail above. Although one (1) retainer is depicted, varying quantities of retainers may be substituted without departing from the scope of the invention. In addition, alternate types of rings may be substituted.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A writing apparatus comprising:

a body, said body including at least one hollow body portion adjacent an open distal end, said open distal end including an access aperture, said at least one hollow body portion accessible via said access aperture;

a retainer including at least one receptacle, said retainer removably coupled to said open distal end, said retainer enclosing said at least one hollow body portion when coupled to said open distal end via blocking of said access aperture, and said retainer allowing access to said at least one hollow body portion when uncoupled from said open distal end via unblocking of said access aperture;

at least one marking mechanism coupled to said body at a location opposite said open distal end; and at least one attachment, said attachment configured to removably mate with said at least one receptacle;

wherein one or more of said at least one attachment may be stored in said at least one hollow body portion.

2. An apparatus according to claim 1, wherein said open distal end includes threads on an exterior surface of said open distal end; and wherein said retainer removably couples to said open distal end via threading.

3. An apparatus according to claim 1, said at least one attachment further comprising:

a head; and a base coupled to said head;

wherein said base removably couples to said receptacle.

4. An apparatus according to claim 1, said at least one receptacle further comprising:

two axial channels located on radially opposing sides of said at least one receptacle;

two retainer protrusions located on a bottom surface of said receptacle;

two retainer recesses located on said bottom surface of said receptacle; and two axial channel recesses located on said bottom surface of said receptacle.

5. An apparatus according to claim 4, wherein said two retainer protrusions include beveled walls.

6. An apparatus according to claim 4, said at least one receptacle further comprising two stops located on said bottom surface of said receptacle.

7. An apparatus according to claim 4, said at least one attachment further comprising:

a head; and a substantially cylindrical base coupled to said head, said base including a bead, a first arced protrusion, and a second arced protrusion, said first and second arced protrusions located on radially opposing sides of said base.

wherein said base removably couples to said receptacle.

8. An apparatus according to claim 3, wherein said head is substantially cylindrical and includes an outer face.

9. An apparatus according to claim 1, wherein a downwardly facing surface of said retainer includes at least one protrusion.

10. A writing apparatus comprising:

a body, said body including a first body section and a hollow second body section, said first body section and said hollow second body section separated via a disk, said hollow second body section adjacent an open distal end, said open distal end including an access aperture, said hollow second body portion accessible via said access aperture;

a retainer including a plurality of receptacles arranged circularly, a centrally located cylindrical recess, and a plurality of arced recesses; said retainer removably coupled to said open distal end, said retainer enclosing said hollow second body section when coupled to said open distal end via blocking of said access aperture, and said retainer allowing access to said hollow second body section when uncoupled from said open distal end via unblocking of said access aperture;

at least one marking mechanism coupled to said body at a location opposite said open distal end; and at least one attachment, said attachment configured to removably mate with said at least one receptacle;

wherein one or more of said at least one attachment may be stored in said hollow second body section.

11. An apparatus according to claim 10, wherein said open distal end includes threads on an exterior surface of said open distal end; and wherein said retainer removably couples to said open distal end via threading.

* * * * *